US011534641B2

(12) United States Patent
Cutting et al.

(10) Patent No.: US 11,534,641 B2
(45) Date of Patent: Dec. 27, 2022

(54) SECTIONAL FIRE PROTECTION FOR ATTIC SPACES

(71) Applicant: Tyco Fire Products LP, Lansdale, PA (US)

(72) Inventors: Sean E. Cutting, West Warwick, RI (US); John Morton Walker, IV, Westerly, RI (US)

(73) Assignee: Tyco Fire Products LP, Lansdale, PA (US)

( * ) Notice: Subject to any disclaimer, the term of this patent is extended or adjusted under 35 U.S.C. 154(b) by 512 days.

(21) Appl. No.: 15/969,531

(22) Filed: May 2, 2018

(65) Prior Publication Data

US 2018/0318620 A1 Nov. 8, 2018

Related U.S. Application Data

(60) Provisional application No. 62/500,864, filed on May 3, 2017.

(51) Int. Cl.

| | |
|---|---|
| ***A62C 37/11*** | (2006.01) |
| ***A62C 31/28*** | (2006.01) |
| ***A62C 35/68*** | (2006.01) |
| ***A62C 31/02*** | (2006.01) |
| ***A62C 3/00*** | (2006.01) |

(52) U.S. Cl.

CPC ..... *A62C 37/11* (2013.01); *A62C 3/00* (2013.01); *A62C 31/02* (2013.01); *A62C 31/28* (2013.01); *A62C 35/68* (2013.01)

(58) Field of Classification Search

CPC ..... A62C 37/11; A62C 3/00; A62C 31/02; A62C 31/28; A62C 35/68

See application file for complete search history.

(56) References Cited

U.S. PATENT DOCUMENTS

| | | | | |
|---|---|---|---|---|
| 4,585,069 | A | 4/1986 | Whitaker | |
| 5,669,449 | A * | 9/1997 | Polan | A62C 37/08 169/16 |
| 8,083,002 | B1 * | 12/2011 | Golinveaux | A62C 35/68 169/46 |
| 8,800,673 | B2 * | 8/2014 | Multer | A62C 35/58 239/524 |
| 2011/0024138 | A1 * | 2/2011 | Multer | A62C 37/11 169/54 |

(Continued)

FOREIGN PATENT DOCUMENTS

WO WO-2017/075070 A1 5/2017

OTHER PUBLICATIONS

National Fire Protection Association NFPA 13: Standard for the Installation of Sprinkler Systems, (2013 ed.), Section 8.6.4.1.3 (7 pages).

(Continued)

*Primary Examiner* — Christopher R Dandridge
(74) *Attorney, Agent, or Firm* — Foley & Lardner LLP

(57) ABSTRACT

Sectional fire protection systems and methods for the protection of an attic space are provided. A fluid control thermal detection device is located above a ceiling base and one or more open fluid distribution devices are disposed, spaced and connected to the fluid control thermal detection device for receipt of firefighting fluid from the fluid control thermal detection device to protect the attic space with a desired fluid density and total system flow demand.

9 Claims, 26 Drawing Sheets

(56) References Cited

U.S. PATENT DOCUMENTS

2015/0343247 A1* 12/2015 Daniels ..... A62C 3/14
454/366
2017/0028238 A1* 2/2017 Meyer ..... F16K 31/002

OTHER PUBLICATIONS

Tyco Fire Products Data Sheet TFP1346 entitled, "Series MJC Multiple Jet Controls DN20, DN25, DN40, DN50, 12 bar BSPT Inlet & Outlet Threads" (Oct. 2014)(10 pages).
Tyco Fire Products LP (Tyco Fire & Building Products—Research & Development) publication entitled "Application: The Use of Specific Application Sprinklers for Protecting Attics" (Dec. 2007)(91 pages).
Tyco Fire Products LP Data Sheet TFP1345 entitled, "Model TCV-1 Thermal Control Valve 1 and 1-1/2 Inch (DN25 and D40), 175 psi (12,1 bar) Thread x Thread" (Jan. 2005)(4 pages).

* cited by examiner

SECTIONAL FIRE PROTECTION FOR ATTIC SPACES

CROSS-REFERENCE TO RELATED APPLICATIONS

The present disclosure claims the benefit of and priority to U.S. Provisional Application No. 62/500,864, titled "SECTIONAL FIRE PROTECTION FOR ATTIC SPACES," filed May 3, 2017, the disclosure of which is incorporated herein by reference in its entirety.

TECHNICAL FIELD

The present disclosure relates generally to fire protection systems and more specifically to fire protection systems for the protection of attic spaces.

BACKGROUND

Under the fire protection industry standard, National Fire Protection Association NFPA 13*: Standard for the Installation of Sprinkler Systems*, (2013 ed.), criteria is specified for the installation of fire protection sprinkler systems for attic spaces. The installation criteria can include sprinkler spacing and location requirements and application density requirements for sprinklers in order to protect attic spaces with peaked or sloped roofs including protection of the eaves regions, the eaves corner and the areas along the base. Current attic fire protection systems employ "automatic sprinklers." NFPA 13 defines an "automatic sprinkler" as "a fire suppression or control device that operates automatically when its heat-activated element is heated to its thermal rating or above, allowing water to discharge over a specified area." The installation requirements can require that automatic sprinklers be installed in each of the peak and eaves regions in order to provide for the designed fire protection including satisfaction of, for example, the 0.1 gallon per square foot (0.1 GPM/SQ. FT.) density requirement.

Attic space can be defined by the intersection of the joists of the roof deck with the joist of the base or ceiling deck and the rise-to-run ratio or pitch from the intersection to the peak of the roof. For the purpose of designing for fire protection of the attic space, the eaves region of the pitched roof can be the triangular sections at the outer edge of the attic space and lateral of the roof peak when viewed in elevation. Moreover, for the purpose of fire protection of the eave region, the eaves region can be defined by the intersection of the roof and ceiling joists and the distance to the first sprinkler disposed medially of the intersection. The location of this first medial sprinkler relative to the intersection defines the vertical of the eaves region to the ceiling deck and the horizontal of the eaves region along the ceiling deck. The location of the first medial sprinkler relative to the intersection of the roof and ceiling joists also defines the hypotenuse of the triangular eaves region in the direction of the sloping roof joists. Section 8.6.4.1.4.3 of NFPA 13 specifies that, fora roof slope of 4 in 12 or greater, the first medial sprinkler is not to be less than five feet (5 ft.) from the intersection of the roof and ceiling joists in the direction of slope. It is believed that, in order to satisfy the preferred 0.1 gpm/sq. ft. density, the first medial sprinkler in known systems using only automatic sprinklers is located at a maximum distance from deflector to the roof ranging from 1 inch to a 22 inches. These current system requirements can pose various problems for complying with design and installation requirements due to unforeseen obstructions and thermal dynamics including, for example, fire growth patterns and the limited thermal responsiveness of automatic sprinklers. For example, automatic sprinkler installation and spacing which locate sprinklers at the five foot minimum distance from the roof and ceiling joist intersection for protection of the eave regions can require installations in low clearance areas below the roof. Additionally, the number of sprinklers in the peak and the eaves contribute to the overall fluid or water demand of the system.

An attic space can include system designs using specific application sprinklers which reduce hydraulic demand over systems using only standard spray sprinklers. In addition to showing attic protection for attic spaces beneath a main, gabled or saddled roof, the Tyco publication details protection of other regions of an attic below other roof types, such as for example, a hip roof, hip-gabled ended roof or where the roof includes a dormer, ross or ell. There is a continued desire for systems which minimize, reduce and/or eliminate installations in the lower clearance area of the eaves region and for systems which can reduce overall hydraulic demand.

SUMMARY

Systems and methods are provided for attic space fire protection. In some embodiments, one or more sectional fire protection sub-systems provide fire protection of an attic space defined by a ceiling base and a roof deck disposed above the ceiling base, the roof deck being sloped with respect to the ceiling base and toward a ridge formation to define a peak and an eaves region. In some embodiments, sectional fire protection sub-systems include at least one fluid control thermal detection device located above the ceiling base proximate the peak region and more preferably within a maximum radial distance of the peak of the peak region. The fluid control thermal detection device includes an inlet and at least one outlet. The systems further preferably include at least one open fluid distribution device disposed between the roof deck and the ceiling base and a pipe connected to the at least one outlet of the at least one fluid control thermal detection device for receipt of fire-fighting fluid from the fluid control thermal detection device. In some embodiments, a method includes locating at least one fluid control thermal detection device having an inlet and at least one outlet above the ceiling base within a maximum radial distance of the peak region. The method also includes piping at least one open fluid distribution device for connection to the at least one outlet.

Embodiments of the sub-system include arrangements of the fluid control and fluid distribution devices to provide protection of zoned or sectional areas of the attic space. Moreover, locations of the fluid distribution devices can be at medial distances from the eaves regions to provide sufficient fluid distribution density in the eaves regions while avoiding or minimizing the low clearance and obstruction issues of the previously known installations. In some embodiments, the systems lower the hydraulic demand of the system by providing sufficient protection with a lower distribution density, e.g., less than 0.1 GPM/SQ. FT. and more preferably a distribution density ranging from 0.05 GPM/SQ. FT. to less than 0.1 GPM/SQ. FT. In some embodiments, systems and methods in accordance with the present disclosure can reduce the hydraulic demand over known systems by reducing the total number of sprinklers used to protect the same attic space.

In some embodiments, systems and methods in accordance with the present disclosure can protect attic spaces beneath conventional and complex roof configurations using only preferred deluge sub-systems. For example, the deluge sub-systems can provide attic space protection for large attic spans, e.g., over forty feet (40 ft.) and preferably up to a maximum span of eighty feet (80 ft.). In some embodiments, the fluid distribution devices employ Model AP 4.2 or 5.6 K-Factor Specific Application Combustible Concealed Space Sprinklers. In some embodiments, the systems and methods provide for distribution fluid density ranging from 0.05-0.1 GPM/SQ. FT., and in some embodiments, ranges from 0.05 GPM/SQ. FT. to less than 0.1 GPM/SQ. FT., for example fluid density ranging from 0.073 GPM/SQ. FT. to 0.080 GPM/SQ. FT., and in some embodiments, 0.05 GPM/SQ. FT. The total number of fluid distribution devices can define the total fluid demand for the sectional protective system. In some embodiments, the total fluid flow system demand is preferably 150 GPM or less.

One implementation of the present disclosure is a deluge fire protection system. The system can protect (e.g., deliver fluid to) an attic space section defined by a ceiling base defining a span of no more than eighty feet and a roof deck sloped above the ceiling to form a ridge line centered above the ceiling base and a peak region of the attic space proximate the ridge line with two eave regions disposed about the ridge line, the attic space having a first end and a second end spaced apart from the first end along the ridge line to define a length of the attic section with at least one baffle between the first and second end disposed perpendicular to the ridge line to define at least two baffled regions of the attic space. The system includes a plurality of fluid control thermal detection devices aligned along the ridge formation proximate the peak region. The system includes a plurality of open fluid distribution devices each coupled to one of the plurality of fluid control thermal detection devices to define no more than six sectional deluge sub-systems spaced apart in an alternating arrangement from the first end to the second end. Each deluge sub-system includes one fluid control thermal detection device and no more than three fluid distribution devices pipe connected with the one fluid control thermal detection device. The fluid distribution devices are axially aligned and spaced apart from one another between the ridge line and one of the eave regions in a direction perpendicular to the ridge line. The axial alignment of the fluid distribution devices of adjacent deluge sub-systems is oppositely directed about the ridge line toward one of the eave regions to define the alternating arrangement.

Another implementation of the present disclosure is a deluge fire protection system. The system can protect (e.g., deliver fluid to) an attic space section defined by a ceiling base defining a span of no more than eighty feet and a roof deck sloped above the ceiling to form a ridge line centered above the ceiling base with two eave regions disposed about the ridge line, the attic space bovine a first end and a second end spaced apart from the first end along the ridge line to define a length of the attic section with at least one shear wall extending from the roof deck to the ceiling base between the first and second ends disposed parallel to the ridge line to define a baffled regions of the attic space. The system includes a plurality of fluid control thermal detection devices consisting of no more than twelve fluid control thermal detection devices having no more than six fluid control thermal detection devices disposed to one side of the shear wall. The system includes a plurality of fluid distribution devices consisting of no more than twenty-four open fluid distribution devices with no more than twelve fluid distribution devices disposed to one side of the sheet wall and coupled to one of the plurality of fluid control thermal detection devices to define no more than six sectional deluge sub-systems for the protection of one baffled region. Each deluge sub-system includes one fluid control thermal detection device and no more than two fluid distribution devices pipe connected with the one fluid control thermal detection device and axially aligned and spaced apart from one another between the ridge line and one of the eave regions in a direction perpendicular to the ridge line.

Another implementation of the present disclosure is a deluge fire protection system. The system can protect (e.g., deliver fluid to) an attic space section defined by a ceiling base defining a span of no more than eighty feet and a roof deck sloped above the ceiling to form a ridge line centered above the ceiling base and a peak region of the attic space proximate the ridge line with two eave regions disposed about the ridge line, the attic space having a first end and a second end spaced apart from the first end along the ridge line to define a length of the attic section with at least one baffle between the first and second end disposed perpendicular to the ridge line to define at least two baffled regions of the attic space. The system includes a plurality of fluid control thermal detection devices consisting of no more than six fluid control thermal detection devices aligned along below the ridge formation. The system includes a plurality fluid distribution devices including no more than twelve open fluid distribution devices each coupled to one of the plurality of fluid control thermal detection devices to define no more than six sectional deluge sub-systems spaced apart from the first end to the second end. Each deluge sub-system includes one fluid control thermal detection device and no more than two fluid distribution devices pipe connected with the one-fluid control thermal detection device axially aligned and spaced apart from one another in a direction aligned with the ridge line.

Another implementation of the present disclosure is a deluge fire protection system. The system can protect (e.g., deliver fluid to) an attic space section defined by a ceiling base defining a span of no more than eighty feet and a roof deck sloped above the ceiling to form a ridge line centered above the ceiling base and a peak region of the attic space proximate the ridge line with two eave regions disposed about the ridge line, the attic space having a first end and a second end spaced apart from the first end along the ridge line to define a length of the attic section with at least one shear wall extending from the roof deck to the ceiling base between the first and second ends disposed parallel to the ridge line to define at least two baffled regions of the attic space. The system includes a plurality of fluid control thermal detection devices consisting of no more than six fluid control thermal detection devices aligned along below the ridge formation. The system includes a plurality fluid distribution devices including no more than twelve open fluid distribution devices each coupled to one of the plurality of fluid control thermal detection devices to define no more than six sectional deluge sub-systems spaced apart from the first end to the second end. Each deluge sub-system includes one fluid control thermal detection device and no more than two fluid distribution devices pipe connected with the one-fluid control thermal detection device axially aligned and spaced apart from one another in a direction aligned with the ridge line.

Another implementation of the present disclosure is a deluge fire protection system. The system can protect (e.g., deliver fluid to) an attic space section defined by a ceiling base defining a span of no more than eighty feet and a roof deck sloped above the ceiling to form a ridge line centered above the ceiling base and a peak region of the attic space proximate the ridge line with two eave regions disposed about the ridge line, the attic space having a first end and a second end spaced apart from the first end along the ridge line to define a length of the attic section with at least one shear wall extending from the roof deck to the ceiling base between the first and second ends disposed parallel to the ridge line to define at least two baffled regions of the attic space. The system includes a plurality of fluid control thermal detection devices including no more than six fluid control thermal detection devices aligned along the ridge formation proximate the peak region. The system includes a plurality fluid distribution devices including no more than twelve open fluid distribution devices each coupled to one of the plurality of fluid control thermal detection devices to define no more than six sectional deluge sub-systems spaced apart from the first end to the second end and disposed to one side of the at least one shear wall for the protection of one of the at least two baffled regions. Each deluge sub-system includes one fluid control thermal detection device and no more than two fluid distribution devices pipe connected with the one fluid control thermal detection device axially aligned and spaced apart from one another in a direction aligned with the ridge line.

Another implementation of the present disclosure is a deluge fire protection system. The system can protect (e.g., deliver fluid to) a HIP end section of an attic space section defined by a ceiling base defining a span of no more than eighty feet and a HIP-type roof adjacent a saddled roof having a central ridge line with two eave regions disposed about the ridge line, the HIP-type roof having two HIP ridge lines intersecting the central ridge line, the HIP end section having a first end and a second end spaced apart from the first end to define a length of the HIP end section with the first end separating the HIP end section from the attic space beneath the saddled roof, the HIP end section including two creeper corner regions of the HIP end section, each creeper corner region being adjacent the second end and contiguous with one of the eave regions, the HIP end section including a baffle extending perpendicular to the central ridge line between the first and second ends to define an upper HIP Section and a lower HIP section. The system includes at least one fluid control thermal detection device aligned along at least one of the HIP ridge lines. The system includes a plurality fluid distribution devices including no more than eighteen open fluid distribution devices each coupled to the at least one fluid control thermal detection device to define at least one sectional deluge sub-system, the plurality of fluid distribution devices including a first group disposed beneath the HIP-type roof above the second baffle for protection of the upper HIP section and a second group disposed beneath the HIP-type roof below the second baffle for protection of the lower HIP section, the second group including at least one fluid distribution device disposed proximate each of the creeper corner regions of the HIP end sections.

Another implementation of the present disclosure is a deluge fire protection system. The system can protect (e.g., deliver fluid to) a HIP end section of an attic space section defined by a ceiling base defining a span of no more than eighty feet and a HIP-type roof adjacent a saddled roof having a central ridge line with two eave regions disposed about the ridge line, the HIP-type roof having two HIP ridge lines intersecting the central ridge line, the HIP end section having a first end and a second end spaced apart from the first end to define a length of the HIP end section with a framing truss aligned at the first end to separate the HIP end section from the attic space beneath the saddled roof, the HIP end section including two creeper corner regions of the HIP end section, each creeper corner region being adjacent the second end and contiguous with one of the eave regions, the HIP end section including a girder extending perpendicular to the central ridge line between the first and second ends to define an upper HIP Section and a lower HIP section. The system includes at least one fluid control thermal detection device aligned along at least one of the HIP ridge lines. The system includes a plurality of fluid distribution devices including no more than eighteen open fluid distribution devices each coupled to the at least one fluid control thermal detection device to define at least one sectional deluge sub-system, the plurality of fluid distribution devices including a first group disposed beneath the HIP-type roof above the second baffle for protection of the upper HIP section and a second group disposed beneath the HIP-type roof below the second baffle for protection of the lower HIP section, the second group including at least one fluid distribution device disposed proximate each of the creeper corner regions of the HIP end sections.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1A:
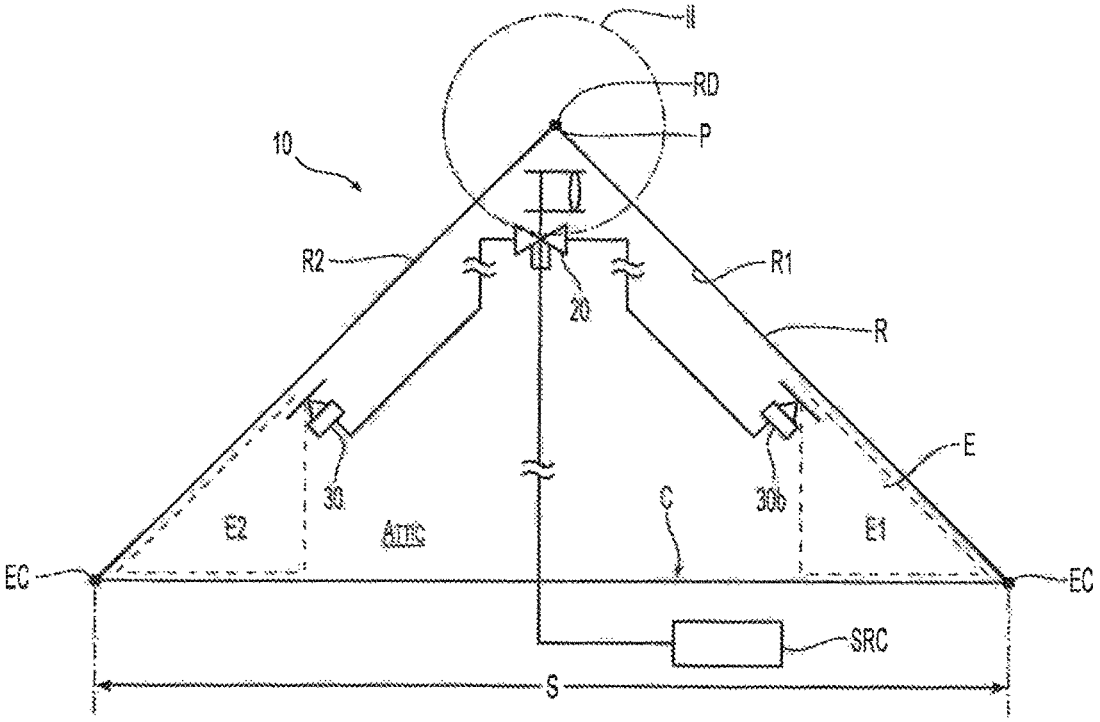
FIG. 1A is a schematic elevation view of a preferred sectional fire protection system for an attic space.
Figure 1B:
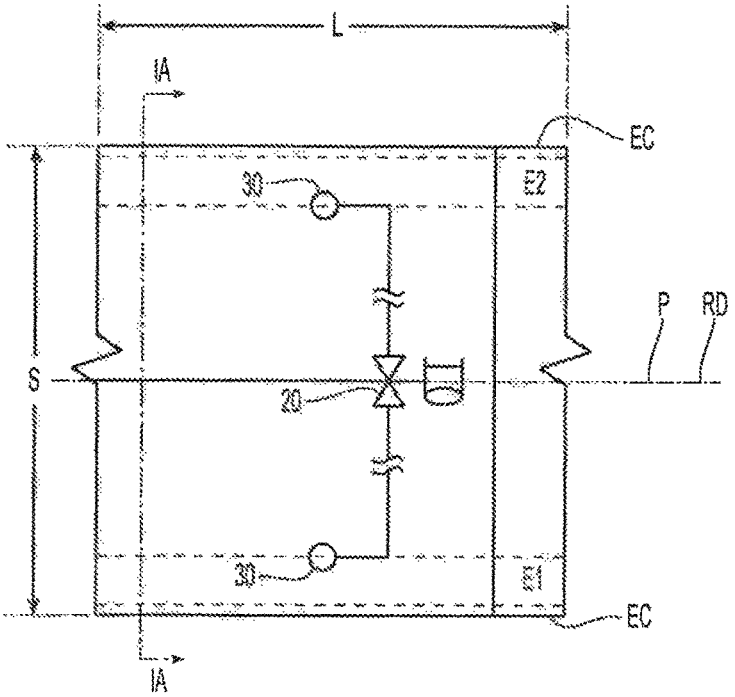
FIG. 1B shows a schematic plane view of the system of FIG. 1A.

Shown in FIGS. 1A-1B is a preferred embodiment of a sectional fire protection system 10 for the protection of a combustible concealed space between a roof deck R and a ceiling base C and more preferably a fire protection system for the protection of an attic space ATTIC. The roof deck R is preferably sloped toward a ridge formation RD to define a slope (rise:run) of 2:12 or greater, preferably 4:12 or greater such as, for example, 8:12, 10:12 and even more preferably 12:12. The roof decks described herein can include two or more portions which slope toward and intersect at the ridge line or formation RD. Although the two portions R1, R2 of the roof deck R are shown as having equal slopes, it should be understood that the two portions can define different slopes. Extending from the roof deck at or proximate the ridge formation RD can be one or more baffles. The baffles can be in the form of, for example, shear walls or draft curtains DC, as seen for example in FIGS. 3D-3E, to divide the attic space ATTIC into two or more section or zones. The one or more baffles can extend parallel to the ridge formation RD or alternatively, extend perpendicular to the ridge formation RD in a spaced apart arrangement. Moreover, the baffle can extend from the roof deck all the way to the ceiling base or extend down to a distance spaced from the ceiling base. An exemplary attic space ATTIC is further defined by a span S of the horizontally extending ceiling base C and outer eaves region(s) E. Preferred systems described herein preferably protect attic spaces or portions thereof having a span S of no more than eighty feet (80 ft.), such as fur example, up to sixty feet (60 ft.); up to forty feet (40 ft.), up to twenty feet (20 ft.) or less.

In the elevation view of the attic space ATTIC and preferred embodiment of the fire protection sectional system 10 in FIG. 1A, the outer eaves regions E can include a first eave region E1 and second eave region E2 disposed laterally about the ridge formation RD and a peak region P. As used herein, a "peak region" P is defined as a high point in the attic space ATTIC beneath a roof deck either along a ridge formation, at the intersection of two or more ridge formations or along the intersection between a roof deck and a draft curtain. Each of the eaves regions E1, E2 is defined by the intersection EC of the roof deck R and ceiling base C. Each of the eaves regions E1, E2 can be further defined by the linear distance to a firefighting fluid distribution device 30 disposed medially of the intersection EC in the direction from the intersection EC to the peak P either measured parallel to the roof deck R or the ceiling base C. Alternatively, the eaves regions E1, E2 can be defined by a minimum vertical height from the ceiling base C to the fluid distribution device 30.

Generally, the preferred sectional fire protection system 10 includes one or more fluid control thermal detection device(s) 20 proximate the peak region P which delivers a firefighting fluid to one or more fluid distribution devices 30 as a controlled response upon detecting one or more products of combustion in the peak region P. The fluid distribution devices 30 are preferably pipe connected to the fluid control thermal detection devices 20 in an open state and spaced about the attic space ATTIC to distribute the firefighting fluid and provide for wetting of surfaces and to address the detected fire and even more preferably suppress the fire. As described herein, the fluid distribution device 30 can be embodied as a fire protection sprinkler, a fire protection nozzle or any other fluid carrying conduit capable of dispersing firefighting fluid in a manner described herein. Depending upon its type, the device 30 can include a fluid deflector or diffuser to define a coverage area of the device 30. Because the fluid distribution devices 20 are connected in an open state to the fluid control device 30, the preferred system 10 thus provides for one or more deluge subsystem(s) for sectional fire protection of the attic spaces ATTIC in which fluid delivery control and fire detection are coupled together and located in the region of the attic in which the products of combustion collect, i.e., in the peak region P. By employing a deluge configuration to protect the attic space, the preferred system 10 separates the fire detection and fluid distribution between distinctly located components of the system so as to overcome the problems encountered in known attic fire protections systems generated by the fire dynamics in attics.

Figure 2:
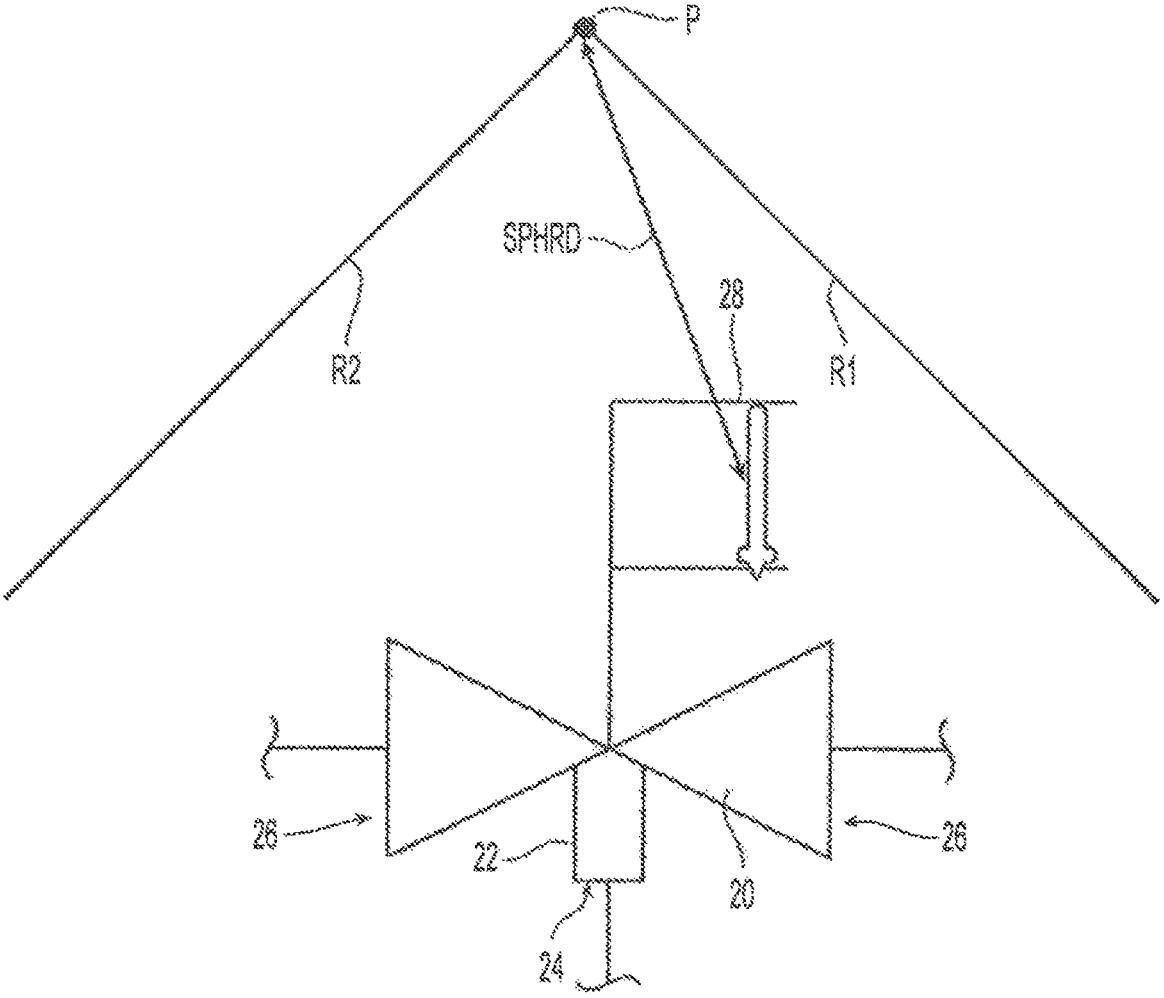
FIG. 2 is a detailed view of an installed fluid control thermal detection device in the system of FIG. 1A.

Referring to FIGS. 1A and 2, the fluid control thermal detection device 20 includes a valve body 22 having an inlet 24 pipe connected to a source SRC of firefighting fluid and one or more outlet(s) 26 pipe connected to the one or more fluid distribution devices 30. The piping connections can include appropriately sized main pipe, fittings, cross-mains, branch lines, sprigs and/or drops to appropriately hydraulically supply each of the fluid control devices 20 and fluid distribution devices 30 with an operative fluid pressure. The preferred valve body 22 has an internal dosed or sealed configuration to prevent fluid flow between the inlet 24 and the outlet(s) 26. The valve body 22 also has an internal open or unsealed condition in which a firefighting fluid can flow from the inlet 24 to the outlet 26 for discharge from the outlet 26. To control the valve internals between its sealed and unsealed conditions, the preferred fluid control thermal detection device 20 includes a thermal spot detection assembly 28 that is linked with the valve body 22. The thermal spot detection assembly 28 preferably includes a thermally responsive element that detects environmental conditions indicative of a fire, i.e., temperature rise, smoke particles, etc., proximate the valve. Upon detecting a fire condition, the thermal spot detection assembly 28 in its linked arrangement with the valve body 22, operates the valve body 22 from its closed configuration to its open configuration to permit internal flow of the firefighting fluid from the inlet 24 to the outlet(s) 26 for delivery to the one or more fluid distribution devices 30.

The preferred system 10 overcomes the disadvantages of the known fire attic space fire protection systems by coupling and locating fire detection and fluid control functions proximate the peak region P. In the case of a fire beneath a sloped ceiling, as previously described, the products of combustion, e.g., heat and smoke, travel and rise up the sloped roof deck R and collect in the peak region P. As shown in FIG. 2, in one preferred embodiment of the sectional fire protection system 10, the fluid control thermal detection device 20 is located above the ceiling base C within a preferred spherical radial distance SPHRD of the peak region P. The spherical radial distance SPHRD is preferably minimized to maximize the clearance between the ceiling base C and the device 20 while locating the thermal spot detection assembly 28 within the area of collected products of combustion to thermally trigger operation of the fluid control device 20 in the event of a fire. In a preferred aspect, the spherical radial distance SPHRD at its maximum is sufficient for the fluid control thermal detection device 20 to be timely actuated by a fire located one foot (1 ft.) in from the eave region E such that the connected fluid distribution devices 30 receive and distribute firefighting fluid to address the fire and minimize or prevent burn through of the roof deck R. Preferably, the thermal spot detection assembly 28 is located within a maximum radius of the peak region P of no more than two feet (24 in.) and more preferably no more than four inches (4 in.). The thermal spot detection assembly 28 can be located within a radius of the peak region P within a preferred range of six to twenty-four inches (6 in.-24 in.) more preferably, ranging from twelve to eighteen inches (12 in.-18 in.). Accordingly, the spot thermal detection assembly can be located within incremental lengths of the preferred ranges, for example anywhere from 22 in., 20 in., 18, in., 16 in., 14 in., 12 in., 10 in., 8 in., 6 in. or any length in between of the peak region P. Upon detecting a fire condition, the fluid control thermal detection device 20 operates to deliver firefighting fluid to the one or more fluid distribution devices 30 which are located to effectively address the fire.

An exemplary embodiment of a fluid control thermal detection device 20 for use in the system 10 can include, for example, the MODEL TCV-1 THERMAL CONTROL VALVE from Tyco Fire Products LP. Another exemplary embodiment of a fluid control thermal detection device for use in the system 10 includes, for example, the MJC MULTIPLE JET CONTROL VALVE from Tyco Fire Products LP. Each of these known thermally responsive fluid control valves includes an integrated or internal thermal spot detection assembly 28 for actuating the valve. Generally, each device includes an internal sealing assembly that is held in the sealed position by either a fusible assembly or a thermally responsive bulb. Once the fusible assembly separates or the bulb fractures in response to the higher temperatures from a fire, the internal sealing assembly moves to an open position and fluid at the inlet of the valve is discharged from the valve outlets for delivery to the fluid distribution devices. Accordingly, the preferred fluid control thermal detection device 2.0 includes a thermally responsive trigger. The trigger of the fluid control devices described herein can be modified with an electrically responsive actuator and coupled to a controller, or other electrical signaling device, to provide for electronic controlled operation of the device 20 for fluid delivery to the open distribution devices 30. The device is schematically shown in FIG. 1A coupled to the firefighting fluid source SRC in a wet pipe system. Alternatively, the device 20 can be supplied by a dry pipe arrangement. Other valve arrangements can be used as the fluid control device provided the arrangement includes a thermal spot detection assembly to control valve operation and fluid flow therethrough.

The fluid distribution device(s) 30 are pipe connected to the outlet 26 of the fluid control thermal detection device 20 for receipt of the firefighting fluid for distribution. The number of fluid distribution devices and their spacing is preferably determined so as to provide a preferred fluid distribution density over the zone or area protected by a given subsystem of the system 10. A preferred provided distribution fluid density ranges from 0.05-0.1 GPM/SQ. FT. and more preferably ranges from 0.05 GPM/SQ. FT. to less than 0.1 GPM/SQ. FT. and even more preferably is 0.05 GPM/SQ. FT.

Referring again to FIGS. 1A and 1B, the fluid distribution device(s) 30 are vertically disposed between the roof deck R and the ceiling base C. The fluid distribution device(s) 30 also are preferably vertically located between the ceiling deck C and the fluid control thermal detection device 20. Various embodiments described herein can alternatively locate the fluid control thermal detection device 20 and the fluid distribution device(s) 30 at substantially the same height from the ceiling base C. For example, a fluid distribution device 30 can be embodied as a sprinkler with a deflector and the sprinkler can be vertically disposed to define a desired sprinkler-to-peak distance or a desired deflector-to-roof deck distance. In one preferred aspect, a preferred sprinkler-to-peak distance can be sized relative to the spherical radial distance SPHRD of the system, for example, it can be equal to or greater than, a percentage or multiple thereof. As seen in FIG. 3E illustrates a preferred sprinkler-to-peak distance can be two to four times the spherical radial distance when the fluid distribution device is located between the ceiling base C and the fluid control thermal detection device 20.

Moreover, as described herein, preferred embodiments of the system arrange the fluid distribution devices 30 relative one another, relative to the fluid control thermal detection device 20, and relative to structures of the attic space ATTICS to provide for the desired fluid distribution in the attic space and its sectioned zones or areas. In particular, the fluid distribution devices 30 are preferably spaced relative one another to provide the preferred fluid distribution density ranging from 0.05 GPM/SQ. FT. to less than 0.1 GPM/SQ. FT. and even more preferably is 0.05 GPM/SQ. FT. In preferred embodiments of the systems described herein, the number of sprinklers can be reduced over prior known systems to reduce the overall hydraulic demand.

Additionally or alternatively, preferred fluid distribution arrangements can locate the fluid distribution devices 30 at greater medial distances from the intersection EC of the roof R and ceiling base C to avoid the clearance issues of prior known systems. The number and location and/or orientation of fluid control thermal detection device(s) 20 and fluid distribution device(s) 30 connected to any one fluid control thermal detection device 20 in preferred embodiments described herein are preferably determined as a function of roof slope, attic span, length of the attic space, and/or baffling within the attic space. For example, the fluid distribution device 30 can also be located laterally or offset from the ridge formation RD or the fluid control thermal detection device 20; or alternatively, the fluid distribution device 30 can be aligned with the ridge formation RD. For example, the fluid distribution device 30 can be laterally spaced from the fluid control thermal detection device 20 at distances that can range from four to twelve feet (7 ft.-12 ft.); eight to eleven feet (8 ft.-11 ft.); eight to ten feet (8 ft.-10 ft.); seven to ten feet (7 ft.-10 ft.); seven to ten feet (7 ft.-10 ft.); seven to eight feet (7 ft.-8 ft.); or four to six feet (4 ft.-6 ft.) Accordingly for some preferred arrangements, the fluid distribution device 30 is preferably located between an eaves regions E or other low clearance areas of an attic space and the fluid control thermal detection device 20. In alternate embodiments, the fluid distribution devices 30 are disposed in a common plane with the fluid control thermal detection device 20, the peak P and or ridge formations. The fluid distribution device(s) 30 can also be disposed to locate their fluid distribution components, such as a deflector member, in a desired location relative to a structure of the attic space and/or other fluid distribution device(s) 30. For example, the first medial fluid distribution device 30 from the eaves regions E can be located at a preferred minimum medial distance to provide for effective fluid density distribution within the eaves regions while overcoming low clearance or obstruction issues. In a preferred aspect, the preferred minimum medial distance to the first fluid distribution device 30 from the intersection EC of the ceiling base C and the roof deck R can range from seven to twelve feet (7 ft.-12 ft.); eight to twelve feet (8 ft.-12 ft.); eight to ten feet (8 ft.-10 ft.); or seven to ten feet (7 ft.-10 ft.). FIG. 1B schematically shows one preferred system arrangement in which one or more fluid distribution devices 30 are laterally spaced from the fluid control device 20, which is aligned with the peak P and preferably aligned with the ridge formation RD. The fluid distribution device(s) 30 can be aligned with one another and off-set from the fluid control device 20 in the direction from the first eaves region E1 to the second eaves region E2 over the span S of the attic space ATTIC.

Figure 3A:
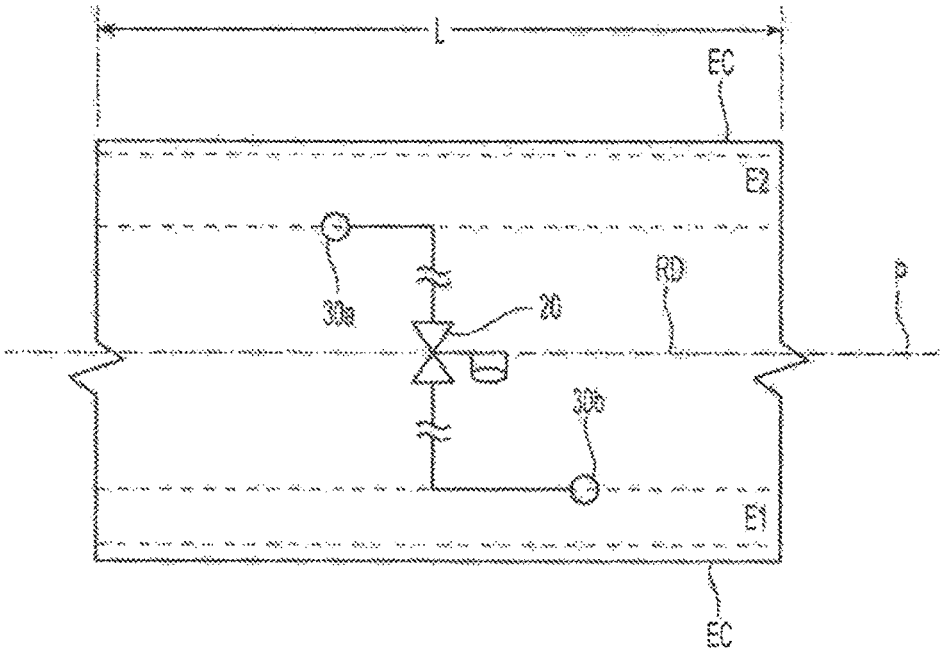
FIGS. 3A-3E are various alternate embodiments of a sectional fire protection system.
Figure 3B:
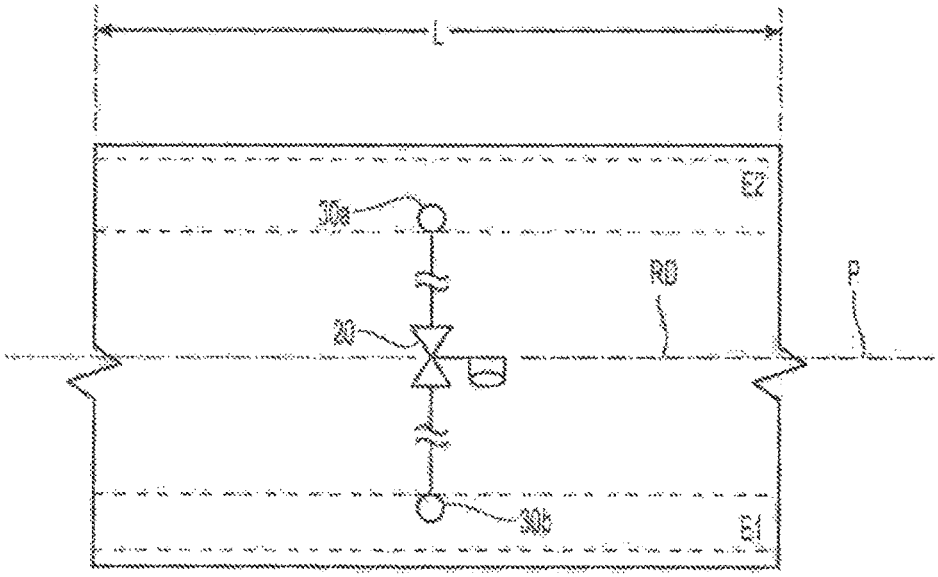
Figure 3C:
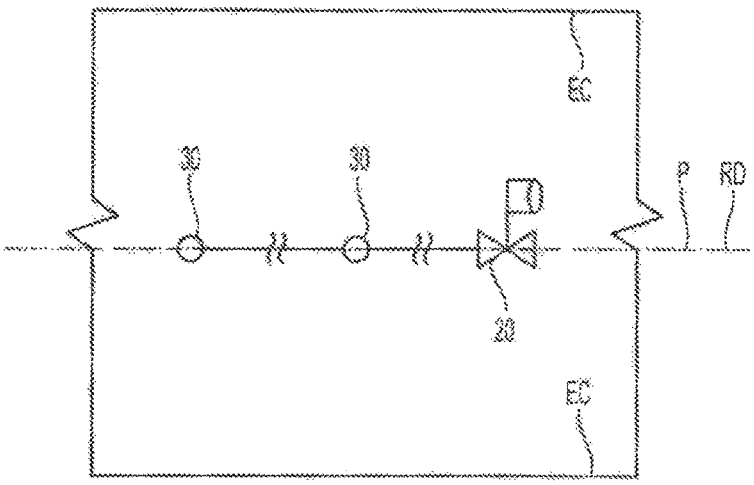
Figure 3D:
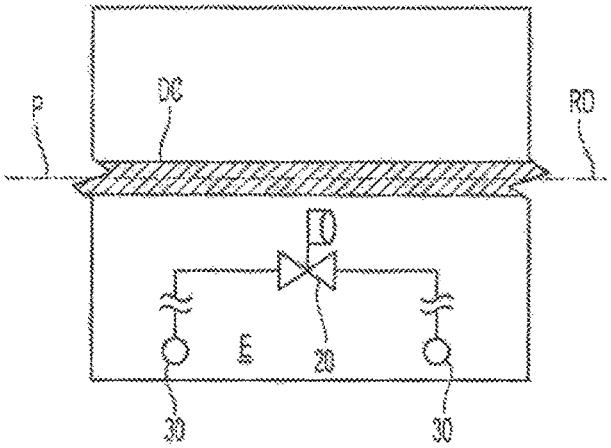
Figure 3E:
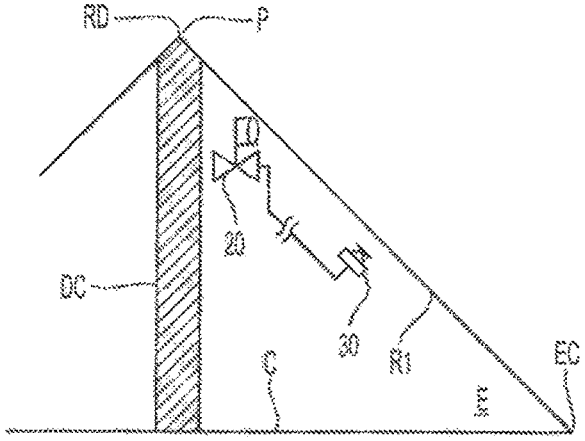

Shown in FIGS. 3A-3E are various preferred plan view layouts of a preferred deluge subsystems in which at least two fluid distribution devices 30 are pipe connected to a common fluid control thermal detection device 20. The deluge sub-systems can be used in combination in the preferred sectional fire protection systems described herein. The figures illustrate preferred relative locations of the fluid control thermal detection device 20 and the fluid distribution device(s) 30 relative to one or more of the attic space peak P, ridge formation RD, eaves regions E and/or a baffles or draft curtains DC. In FIG. 3A, two fluid distribution devices 30*a*, 30*b* are disposed laterally about the fluid control thermal detection device 20, which is aligned with the peak P and the ridge formation RD. The distribution devices 30*a*, 30*b* are staggered and offset from one another in the direction from eave region-to-eave region E1, E2. Shown in FIG. 3B, the two fluid distribution devices 30*a*, 30*b* are laterally disposed about the co-aligned fluid control thermal detection device 20, peak P and ridge formation RD. The distribution devices 30*a*, 30*b* are aligned with one another and preferably aligned with the fluid distribution device 20 in the direction from eave region-to-eave region E1, E2, Shown in FIG. 3C, two fluid distribution devices 30*a*, 30*b* are aligned with the fluid control thermal detection device 20. The distribution devices 30*a*, 30*b* are aligned with one another and axially spaced from the fluid distribution device 20 in the direction parallel to the length L of the peak or ridge formation RD.

In FIGS. 3D and 3E, the two fluid distribution devices 30*a*, 30*b* and the fluid control thermal detection device 20 are shown disposed laterally of a baffle or draft curtain DC that extends along the peak P and ridge formation RD with the fluid control thermal detection device 20 proximate the peak region P. The fluid distribution devices 30 are preferably disposed between one of the eaves regions E and the fluid control thermal detection device 20. Depending on the exemplary embodiments shown and described herein, the piping connecting between the fluid distribution device(s) 30 and the fluid control thermal detection device 20 can be any one of parallel to, perpendicular to, or skewed or a combination thereof relative to the ridge formation RD, draft curtain DC, peak P and/or roof deck R. Moreover, the piping can be steel piping or alternatively CPVC Piping.

Figure 4A:
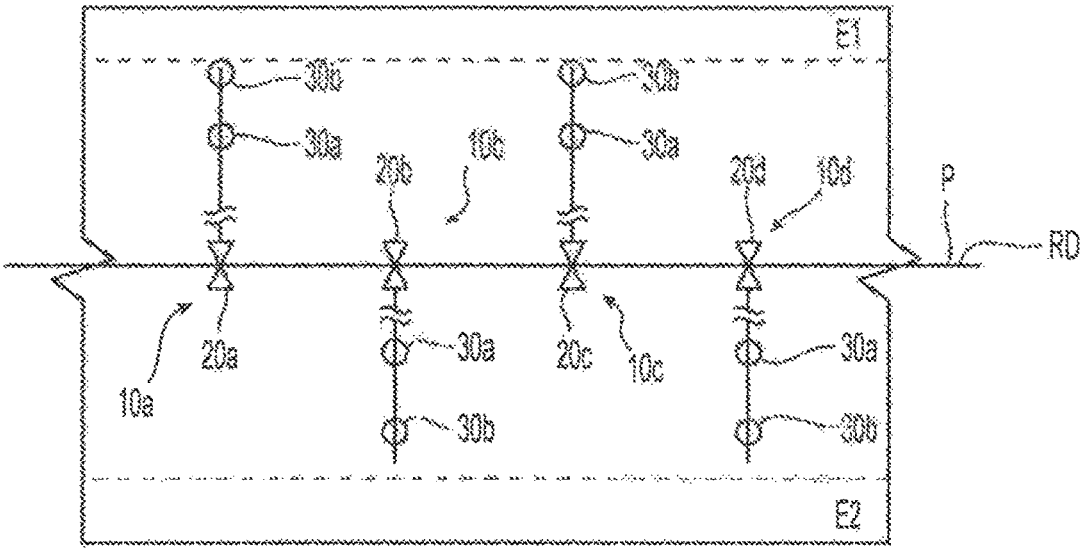
FIG. 4A is a plan schematic view of a preferred attic fire protection system using a plurality of preferred sectional fire protection systems.

FIGS. 3A-3E are illustrative embodiments of preferred single sectional fire protection sub-system layout. The preferred systems can be replicated and/or combined to provide for a preferred sectional fire protection system for fire protection of the full attic space or large portions thereof. For example, shown in FIG. 4A is an attic space ATTIC protected by a group of axially spaced deluge sub-systems 10*a*, 10*b*, 10*c*, 10*d* each having one fluid control thermal detection device 20*a*, 20*b*, 20*c*, 20*d* proximate the peak P with two fluid distribution devices 30*a*, 30*b* coupled to the fluid control device 20. The sub-systems are preferably arranged so that the fluid distribution devices are located between the fluid control devices 20 and one of the eaves E in an alternating fashion. Additionally or alternatively, one or more draft curtains DC (not shown) can depend from and extend in a direction either parallel to or perpendicular to the P and ridge formation RD. Thus as shown, the sectional systems 10*a*, 10*b*, 10*c*, 10*d* are oriented with respect to one another to provide for a preferably staggered arrangement in which the fluid control thermal detection devices 20*a*, 20*b*, 20*c*, 20*d* and their respective pairs of fluid distribution devices 30*a*, 30*b* are alternately positioned about the peak P and aligned in a direction toward the opposed eaves E1, E2. In a preferred embodiment, the fluid control thermal detection devices 20*a*, 20*b*, 20*c*, 20*d* and their respective fluid distribution devices 30 are spaced from another and hydraulically supplied such that they provide a preferred maximum distribution density ranging from 0.05-0.1 GPM/SQ. FT and more preferably 0.05 GPM/SQ. FT. to less than 0.1 GPM/SQ. FT.

Figure 4B:
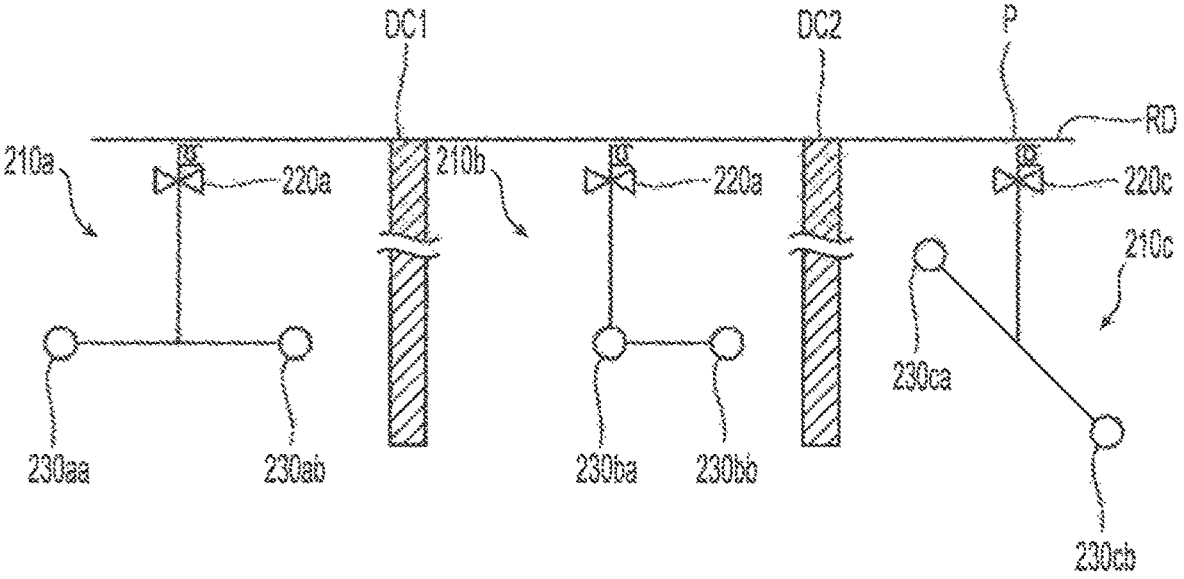
FIG. 4B is a plan side view of another preferred attic fire protection system using a plurality of preferred sectional fire protection systems.

In an alternate embodiment of the system 200, shown in elevation in FIG. 4B, having two or more and preferably three or more sub-systems 210*a*, 210*b*, 210*c* each having a fluid control thermal detection device 220 disposed proximate the peak region P with two fluid distribution devices 230*a*, 230*b* coupled to and depending about the fluid distribution device 230. In a preferred arrangement, the first sectional system 210*a*, the fluid distribution devices 230*aa*, 230*ab* are aligned along the peak P beneath the ridge formation RD. In the second sectional system 210*b*, a first fluid distribution device 230*ba* is axially aligned with the fluid distribution device 230*b* and the second fluid distribution device, 230*bb* axially is spaced from the first distribution device and aligned with the peak P. In the third sectional system 210*c*, the fluid distribution devices 230*ca*, 230*cb* are axially aligned with one another and skewed with respect to the peak P and more preferably extend perpendicular to the peak P. In a preferred embodiment, the fluid control devices 220*a*, 220*b*, 220*c* and their respective fluid distribution devices 230*a*, 230*b* are spaced and hydraulically supplied to provide for 0.05-0.1 GPM/SQ. FT. and more preferably 0.05 GPM/SQ. FT. to less than 0.1 GPM/SQ. FT from each sectional system 210*a*, 210*b*, 210*c* upon the operation of a maximum of two fluid control thermal detection devices 220*a*, 220*b*, 220*c*.

Alternatively to mixing sub-systems of varying configurations, a system can be constructed by replicating a preferred sub-system, for example, first sectional system 210*a*. In another alternative embodiment, two or more of the first sectional systems 210*a* can be disposed laterally about the ridge formation RD instead of vertically aligned with the ridge formation with the sub-system components aligned parallel to the ridge formation RD. Moreover, the multiple sub-systems 210*a* can be axially spaced apart to one side of the ridge formation RD in the direction of the formation. Additionally or alternatively, a draft curtain DC can extend between or parallel to the preferred deluge sub-systems. The draft curtains DC can be appropriately oriented parallel or perpendicular to the ridge formation RD to appropriately section the attic space.

Figure 4C:
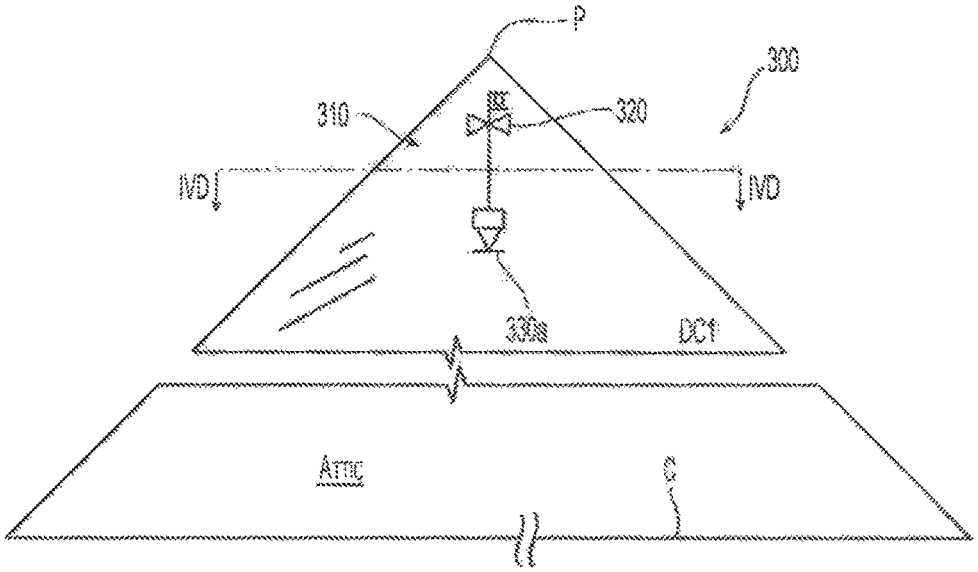
FIGS. 4C-4D are elevation and plan schematic views of another preferred attic fire protection system using a plurality of preferred sectional fire protection systems with draft curtains.
Figure 4D:
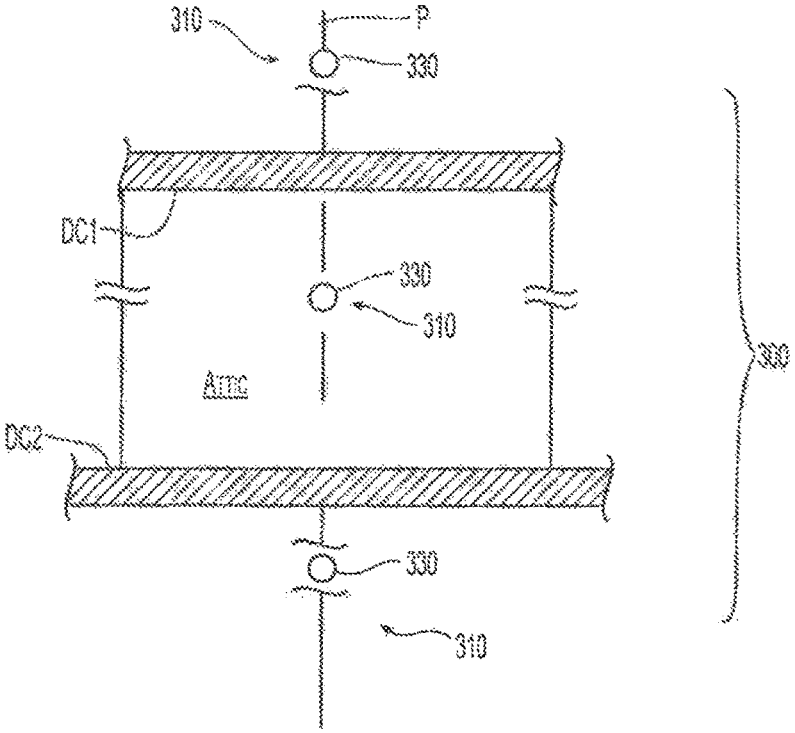

Shown in FIGS. 4C and 4D is another preferred embodiment of a sub-system 300 for providing sectional fire protection to an attic space divided by a plurality of draft curtains DC1, DC2 extending below and perpendicular to the peak P. Located proximate the peak region P is a fluid control device 320 with one fluid distribution device 330 depending from and axially aligned with the fluid control device 320. The fluid distribution device 330 preferably includes a deflector member 330*a* and is preferably axially located between the fluid control device 320 and the ceiling deck C, such that the fluid distribution device 330 distributes a preferred density ranging from 0.05-0.1 GPM/SQ. FT. and more preferably 0.05 GPM/SQ. FT. to less than 0.1 GPM/SQ. FT over the entire area between the draft curtain DC1, DC2 and across the span S of the attic space ATTIC upon operation of the fluid control device 320.

In one preferred embodiment, there is a sectional system 310 to protect a portion of an attic space ATTIC between first and second draft curtains DC1, DC2 defining an area A of 480 SQ. FT. to be protected. With a preferred design density of 0.05 GPM/SQ. FT, the area can be protected at a flow rate of 24 GPM from a preferred single fluid distribution device 330. In a preferred embodiment of system 300 hydraulically designed to a maximum flow rate of 120 GPM, a total of five sectional sub-systems 310 can be spaced about the attic space ATTIC. In a preferred hydraulic design at an appropriate design safety factor of, for example, 1.5 the fire protection system 300 can be hydraulic designed for the simultaneous operation of three sectional sub-systems 310 each flowing at a rate of 24 GPM. Where a preferred minimum operating pressure of 33 PSI is provided to the fluid control thermal detection device 320, the preferred flow rate of 24 GPM can be provided by a fluid distribution device defining a nominal K-Factor of 4.2 GPM/$(PSI)^{1/2}$. Accordingly, a total of 1,440 SQ. FT. of attic space can be protected by the system 300 having three preferred sectional sub-systems 310*a*, 310*b*, 310*c* each covering a preferred 480 SQ. FT.

Figure 5:
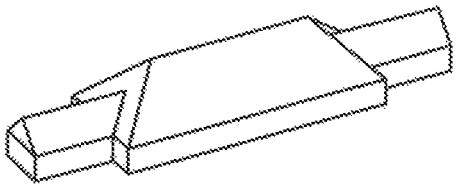
FIG. 5 is an illustrative embodiment of a complex roof configuration.
Figure 5A:
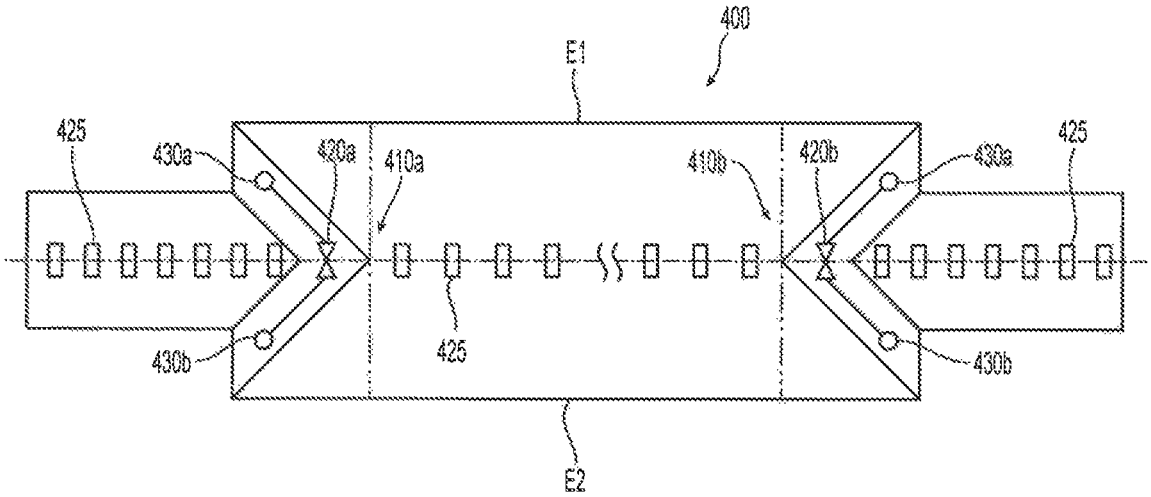
FIGS. 5A-5H are preferred embodiments of attic fire system for protecting the attic space of FIG. 5.
Figure 5B:
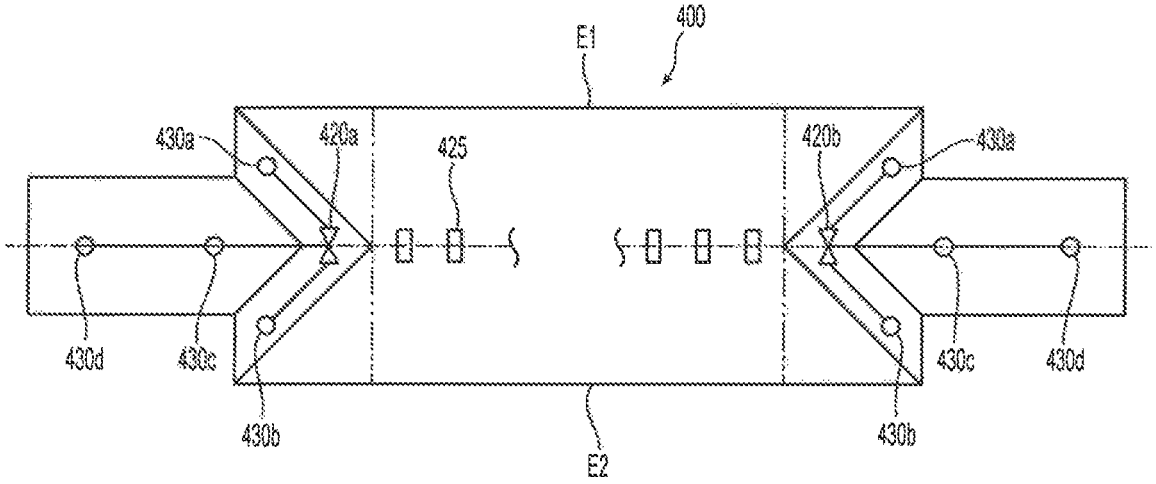

As shown, a complete attic space can be protected by one or more of the preferred sectional tire protection sub-systems. Alternatively or additionally, complex attic spaces can be protected by one or more of the preferred sectional fire protection systems alone or in combination with existing attic space fire protection systems or portions thereof, as shown and described in the Tyco Publication. As used herein, a "complex attic space" is a combination of roof configurations, such as for example, dormers, cross sections, and hip regions. A complex attic system configuration having a central or main hip roof with a maximum span S of forty feet (40 ft.) and two smaller gable ended attic spaces each having a maximum span SS of twenty feet (20 ft.) is shown in FIG. 5. The Tyco Publication described that such an attic space can be protected by either: (i) ninety-two (92) standard spray sprinklers having a nominal K-Factor of 4.2 hydraulically designed to a minimum design area of 1463 SQ. FT. with twenty-nine design sprinklers, providing a maximum total flow rate of 322 GPM to provide a density of 0.2 GPM/SQ. FT.; or (ii) a combination of twenty-four (24) Model BB3 sprinklers with thirty-four (34) AP sprinklers hydraulically designed over the same 1463 SQ. FT. design area with five Model BB3 sprinklers providing a flow of design and two Model AP Sprinklers to provide a total minimum flow of 147 GPM at a density of 0.1 GPM/SQ. FT.

It is believed that use of the preferred sectional system(s) 10 described herein, alone or in combination with the previously known attic systems, can reduce the total number of sprinklers and/or hydraulic demand over previously known fire protection systems to protect similarly sized and configured attic spaces. Shown in FIGS. 5A-5H are schematic illustrations of preferred sectional fire protection systems to provide protection of a similar complex roof configuration. In a preferred embodiment of a system 400 shown in FIG. 5A, each of the two end hip regions of the central main roof is protected by a preferred sectional sub-system 410*a*, 410*b* having a fluid control thermal detection device or valve 420*a*, 420*b* located proximate the peak region P and the intersection of the ridge formation RD with the hip region. Preferably depending from each fluid control device are two fluid distribution devices 430*a*, 430*b* each located proximate to and extending along the ridges of the hip. Each of the main roof and the end gable roofs are protected by Model BB3 sprinklers 425 axially aligned along the peak or ridge formations of the respective roof regions. More specifically, the main roof is protected by ten Model BB3 sprinklers 425 and each of the end gable roofs are protected by seven Model BB3 sprinklers 425. The Model BB3 sprinklers 425 are separately or independently pipe connected to the fluid supply source either in a wet pipe system or a dry pipe system. The fluid distribution devices 430*a*, 430*b* can be embodied by any open sprinkler or nozzle described herein provided the preferred sectional sub-system 410 and other sprinklers or fluid distribution devices provide a preferred 0.1 GPM/SQ. FT. fluid density or greater. In a preferred embodiment, the system 400 is hydraulically designed and a number of Model BB3 sprinklers 425 provide the preferred density of 0.1 GPM/SQ. FT. over a design area such as, for example, 1463 SQ. FT. More preferably, the system 400 is hydraulically designed such that the sectional sub-systems 410*a*, 410*b* and a select number of Model BB3 sprinklers provide the preferred density ranging from 0.05-0.1 GPM/SQ. FT. and more preferably 0.05 GPM/SQ. FT. to less than 0.1 GPM/SQ. FT over a preferred design area.

Alternate arrangements of the system 400*a* can be made to further reduce the total number of sprinklers in the system while maintaining the desired distribution density. More particularly, the number and location of fluid distribution devices are identified to provide the preferred designed fluid density ranging from 0.05-0.1 GPM/SQ. FT. In an alternate arrangement, shown in FIG. 5B, the number of Model BB3 sprinklers 425 can he further reduced by additionally or alternatively locating two fluid distribution devices 430*c*, 430*d* along the peak of gable ended roof sections in place of the seven Model BB3 sprinklers located in each of the gable ended roof sections.

Figure 5C:
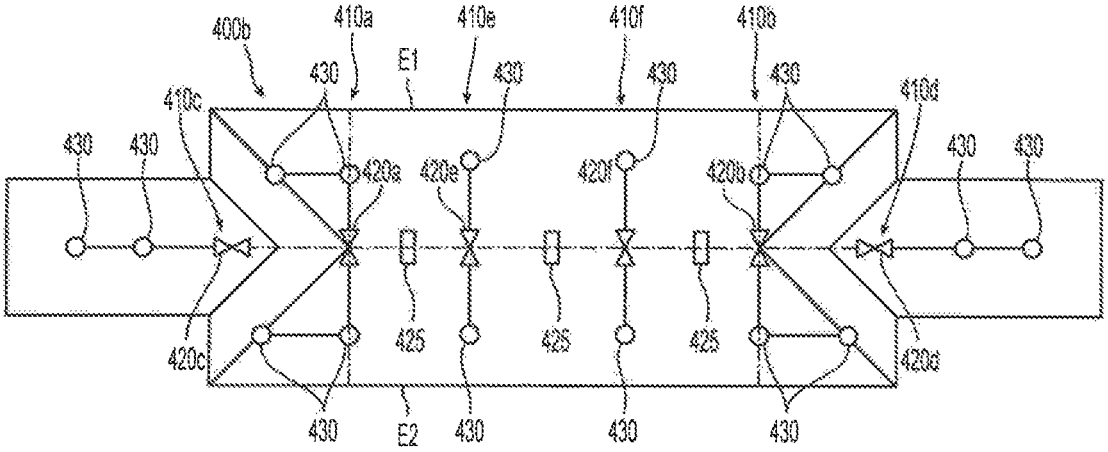

Shown in FIG. 5C is another alternate embodiment of the fire protection system 400*b* in which the number of Model BB3 sprinklers in the main roof is reduced and replaced by a plurality of preferred sectional fire protection deluge sub-systems 410*a*, 410*b*, 410*c*, 410*d*, 410*e*, 410*f*. Each of the section systems 410 includes a fluid control thermal detection device 420*a*, 420*b*, 420*c*, 420*d*, 420*e*, 420*f* spaced apart from one another and aligned proximate the peak region P of the main roof. Preferably evenly disposed between adjacent fluid control devices 420 is a Model BB3 sprinkler 425 located at the peak or ridge of the roof. Coupled to and depending from each of the fluid control thermal detection devices 420 are a plurality of fluid distribution devices 430 arranged in a manner as previously described. For example, four fluid control thermal detection devices 420*a*, 420*b*, 420*e*, 420*f* are evenly spaced proximate the peak region P vertically aligned with the ridge formation RD. Preferably, each of the four fluid control devices include two fluid distribution devices 430 aligned between the fluid control device 420 and an eaves regions E1, E2 to each side of the ridge formation RD. Intermittently disposed between the four fluid control devices 420*a*, 420*e*, 420*f*, 420*b* are three Model 8B3 sprinklers 425*a*, 425*b*, 425*c*. Each of the two fluid control devices 420*a*, 420*b*, located at the ends of the main roof proximate the hip regions, preferably includes four fluid distribution devices 430 with two fluid distribution devices disposed along the angled hip of the hip regions. The gabled end roof sections are each preferably protected by a fluid control thermal detection device 420*c*, 420*d* with two fluid distribution devices 430 axially aligned with the peak of the roof section. In complex roofs without gabled ends, the hip sections can be alternatively protected by coupling preferably more than two fluid distribution devices 430 to the fluid control thermal detection devices 420*a*, 420*b* proximate the peak intersection with the hip regions at the ends of the main roof. More specifically, four or more open fluid distribution devices 430 can be arranged proximate the base of the hip region and coupled to the unactuated fluid control thermal detection device 420*a*, 420*b* to provide protection of the eaves in the hip region and in the area proximate the intersection of the sloping hip roof and the ceiling base.

Figure 5D:
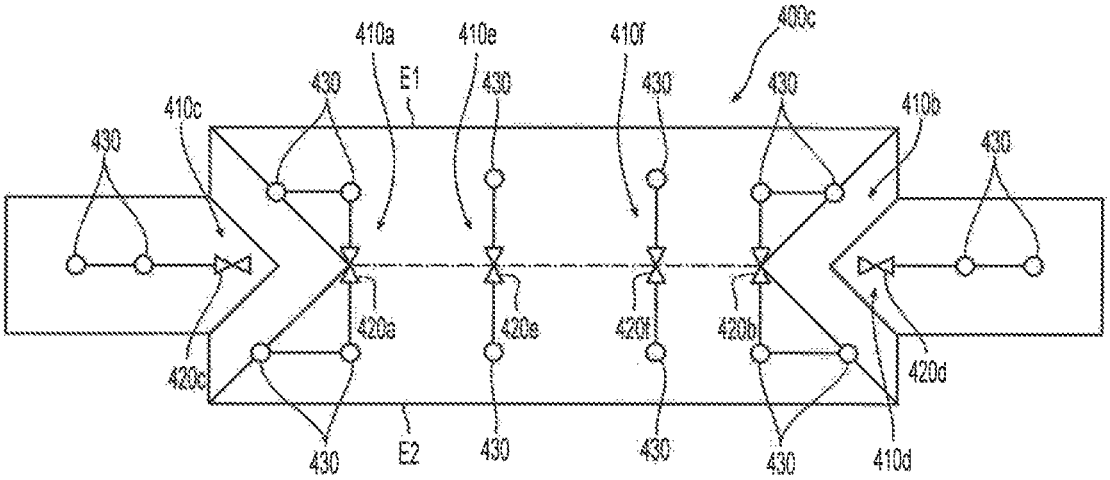
Figure 5E:
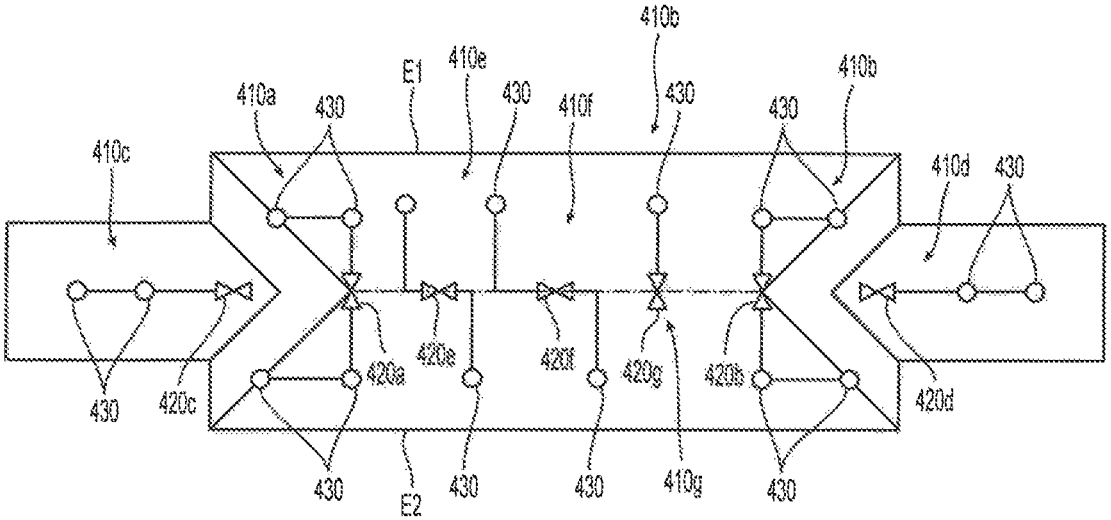
Figure 5F:
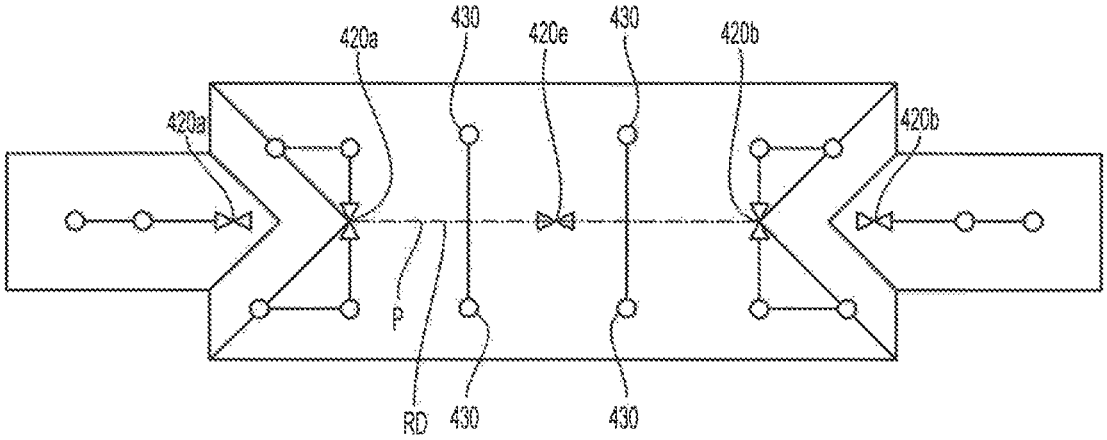

In another alternate embodiment of the system 400*c*, shown in FIG. 5D, the Model BB sprinklers are removed to further reduce the total number of sprinklers. The systems 400*b*, 400*c* are preferably hydraulically designed so that a number of sectional protection sub-systems 410 and Model BB3 sprinklers, where applicable, provide the preferred density ranging from 0.05-0.1 GPM/SQ. FT. and the more preferred 0.05 GPM/SQ. FT. to less than 0.1 GPM/SQ. FT fluid density over a preferred design area. Shown in FIGS. 5E and 5F are additional alternative embodiments of the attic fire protection system 400*d*, 400*e* in which the entire attic space is protected by a combination of various sectional fire protections sub-systems 410. In FIG. 5E, seven sub-systems 410*a*, 410*b*, 410*c*, 410*d*, 410*e*, 410*f*, 410*g* each include a fluid control thermal detection device 420*a*, 420*b*, 420*c*, 420*d*, 420*e*, 420*f*, 420*g* evenly spaced proximate the peak region P. Each of the four fluid control devices 420*a*, 420*b*, 420*c*, 420*d* includes at least one fluid distribution device 430 disposed between the fluid control device 420 and at least one of the eaves E1, E2. Preferably, the fluid distribution devices 430 coupled to the intermediately disposed fluid control devices 420*e*, 420*f*, 420*g* are in a staggered or off-set arrangement with one fluid control device 420*g* having only one fluid distribution device 430 coupled to it to provide the desired coverage in the staggered arrangement. The two fluid control devices 420*a*, 420*b* located at the ends of the main roof proximate the hip regions each preferably includes four fluid distribution devices 430 with two fluid distribution devices disposed along the angled hip of the hip regions. The gabled end roof sections are each protected by a fluid control thermal detection device 420*c*, 420*d* with two fluid distribution devices 430 axially aligned with the peak of the roof section.

In another alternate embodiment of the system 400*e*, shown in FIG. 5F, the total number of fluid control thermal detection devices 420 is reduced to three sectional systems to protect the central main roof section. Two fluid control devices 420*a*, 420*b* are preferably located at the ends of the main roof proximate the hip regions, along with four fluid distribution devices 430 that include two fluid distribution devices disposed along the angled hip of each hip region. A centrally disposed fluid control thermal detection device 420*e* is positioned proximate the peak region P. Preferably disposed about the central fluid control device 420*e* are four fluid distribution devices 430 in a preferred "H-shaped" formation to provide for fluid distribution about the peak P. The gabled end roof sections are each protected by a fluid control thermal detection device 420*c*, 420*d* with two fluid distribution devices 430 axially aligned with the peak of the roof section. The systems 400*d*, 400*e* are preferably hydraulically designed so that a select number of sectional protection sub-systems 410 provide the preferred density ranging from 0.05-0.1 GPM/SQ. FT. and more preferably 0.05 GPM/SQ. FT. to less than 0.1 GPM/SQ. FT over a preferred design area.

Figure 5G:
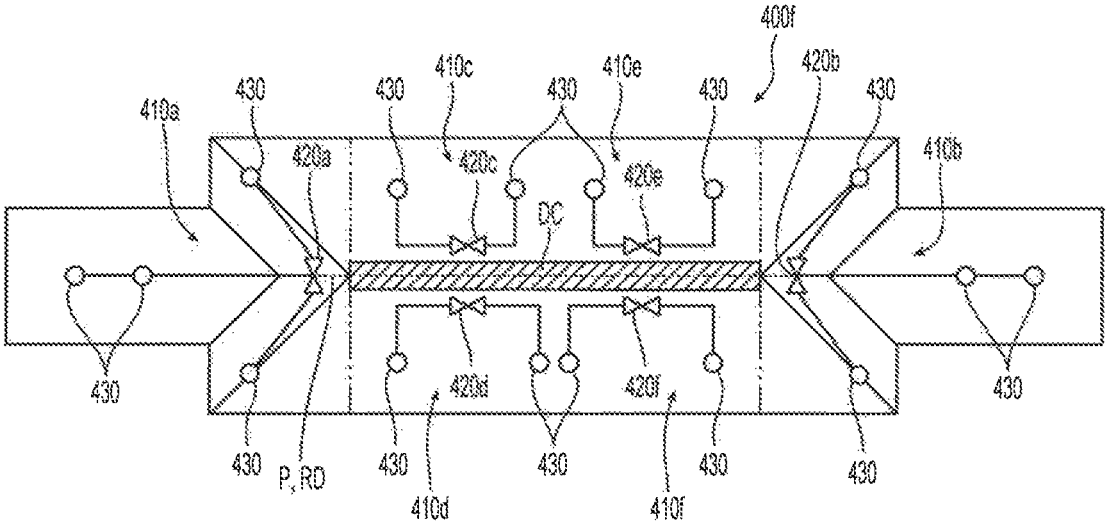
Figure 5H:
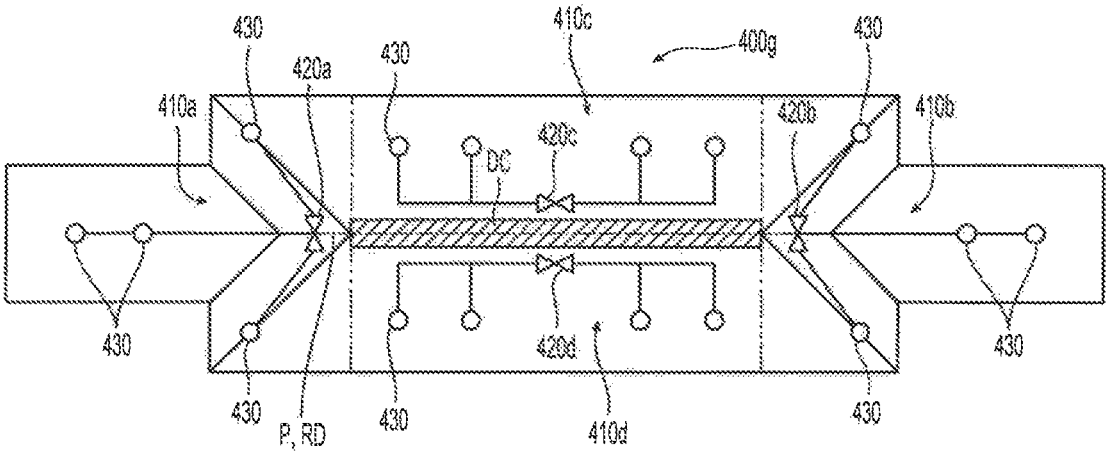

Shown in FIGS. 5G and 5H are additional alternative embodiments of the attic fire protection systems 400*f*, 400*g* with a draft curtain for protection of an attic space. In a preferred embodiment of a system 400*f* shown in FIG. 5G, each of the end hip regions of the central main roof is protected by a preferred sectional sub-system 410*a*, 410*b* having one fluid control thermal detection device 420*a*, 420*b* located proximate the peak region P and its intersection with the hip region and two fluid distribution devices 430 aligned along the peak of the gable ended roof sections. In an alternate arrangement, the fluid distribution devices in the hip region can be staggered in the hip region. More specifically, adjacent rows of sprinklers in the hip region below the sloping roof can be staggered in the direction from the ceiling base toward the peak and connected to the fluid distribution device.

As shown in FIGS. 5G and 5H, the main roof section is divided by a draft curtain DC that extends along the length of the peak P. Four sectional protection sub-systems 410*c*, 410*d*, 410*e*, 410*f* are evenly spaced along and about the peak region P and draft curtain DC of the main central roof section. Each fluid control device 420*c*, 420*d*, 420*e*, 420*f* has two fluid distribution devices 430 depending therefrom and located between the fluid control device 420 and one of the eaves regions E1, E2. In one preferred aspect, the fluid distribution devices 430 are axially spaced apart from one another in the direction of the peak by a distance of twenty feet (20 ft.).

In the alternate embodiment of the system 400*g*, as shown in FIG. 5H, the number of fluid control thermal detection devices is reduced in the main roof section of the attic configuration. In particular, two sectional protection sub-systems 410*c*, 410*d* are centered and disposed about the peak region P and draft curtain DC. Each fluid control device 420*c*, 420*d* has four fluid distribution devices 430 depending therefrom and located between the fluid control device 420 and one of the eaves regions E1, E2. The systems 400*f*, 400*g* are preferably hydraulically designed so that a select number of sectional protection subsystems 410 provides the preferred density ranging from 0.05-0.1 GPM/SQ. FT. and more preferably 0.05 GPM/SQ. FT. to less than 0.1 GPM/SQ. FT over a preferred design area.

The preferred system configurations of FIGS. 5A-5H are for a roof span S of forty feet (40 ft.). It is believed that attic configurations of greater spans, such as for example, up to sixty feet (60 ft.) or up to a maximum span of eighty feet (80 ft.) can be protected by adding and positioning additional fluid distribution devices parallel to or in series with the previously described distribution devices of the sectional fire protection system. The expanded sectional fire protection systems are preferably hydraulically designed to provide the preferred fluid distribution density ranging from 0.05-0.1 GPM/SQ. FT. and more preferably 0.05 GPM/SQ. FT. to less than 0.1 GPM/SQ. FT over a preferred design area.

Figure 6A:
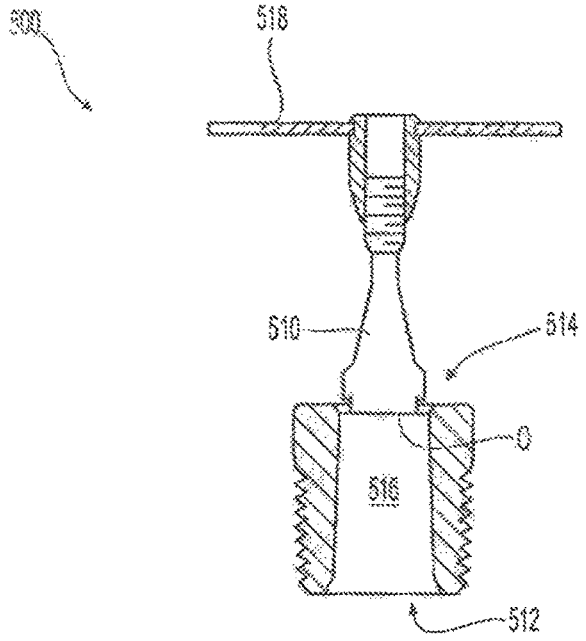
FIGS. 6A-6B are cross-sectional and elevation views of a preferred fluid distribution device for use in the systems of FIG. 1A.
Figure 6B:
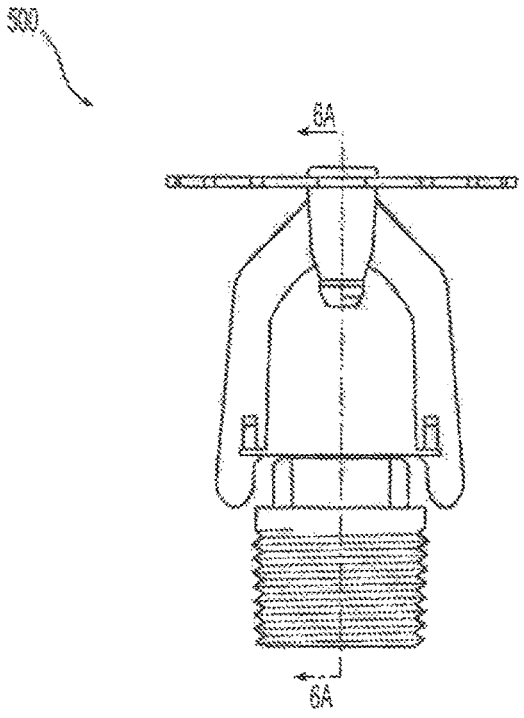
Figure 7A:
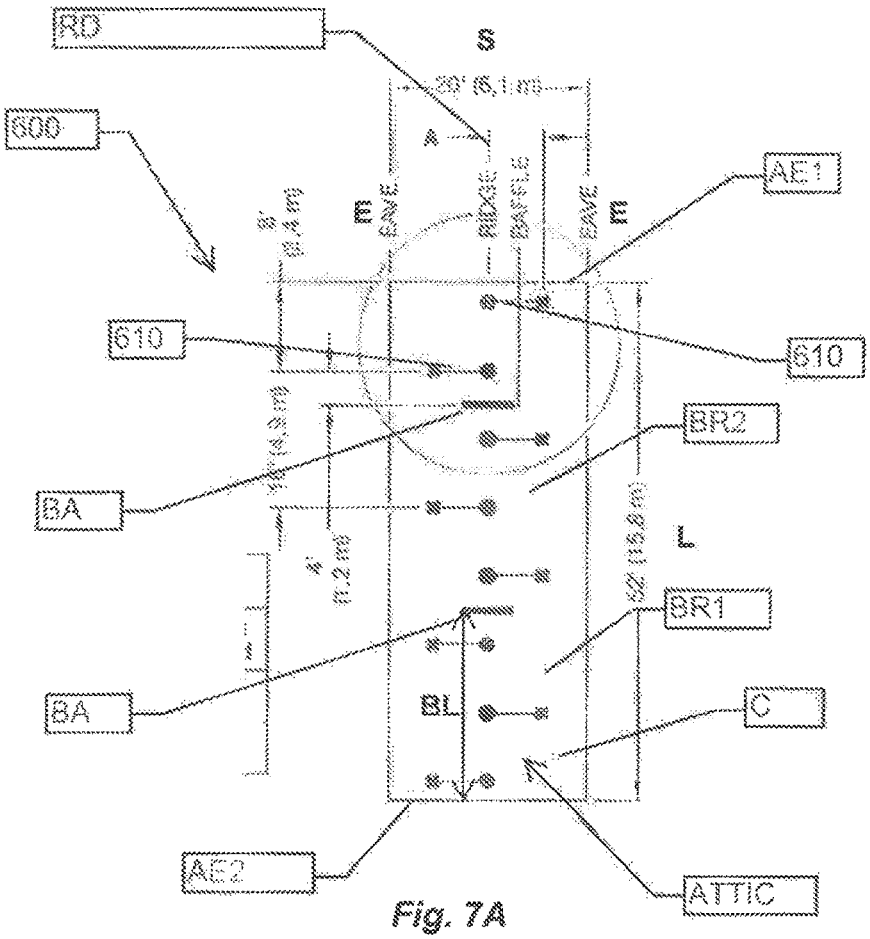
FIGS. 7A-7G schematically shows various views of preferred embodiments of an attic fire system having deluge sub-systems in an alternating arrangement.
Figure 7B:
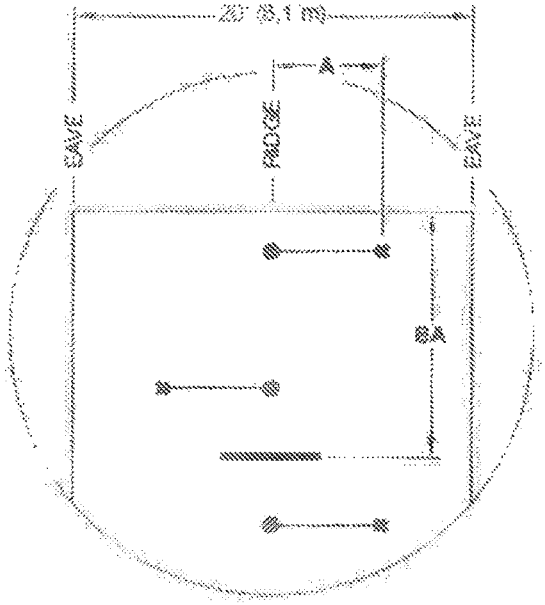
Figure 7C:
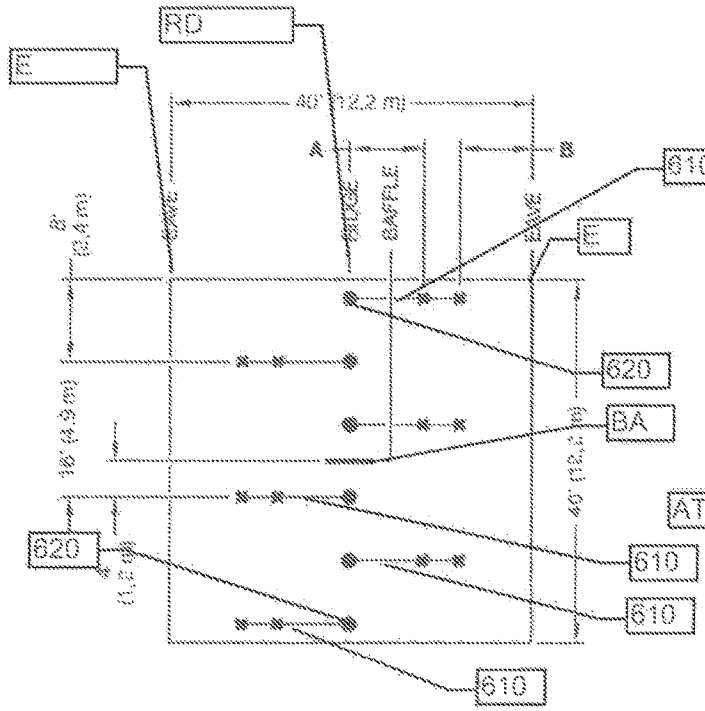
Figure 7D:
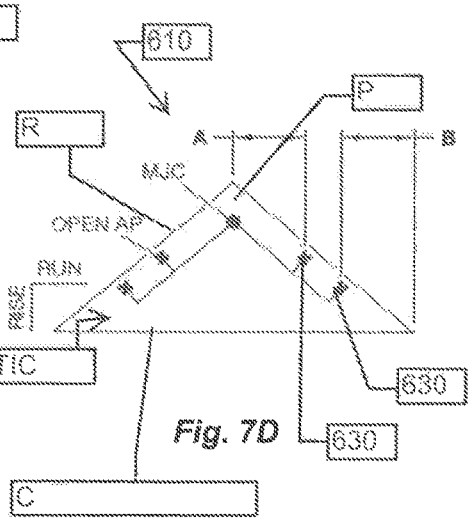
Figure 7E:
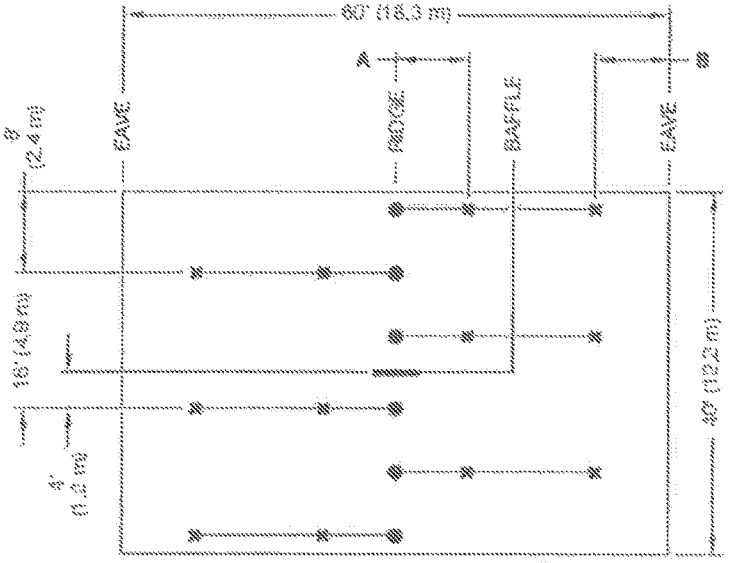
Figure 7F:
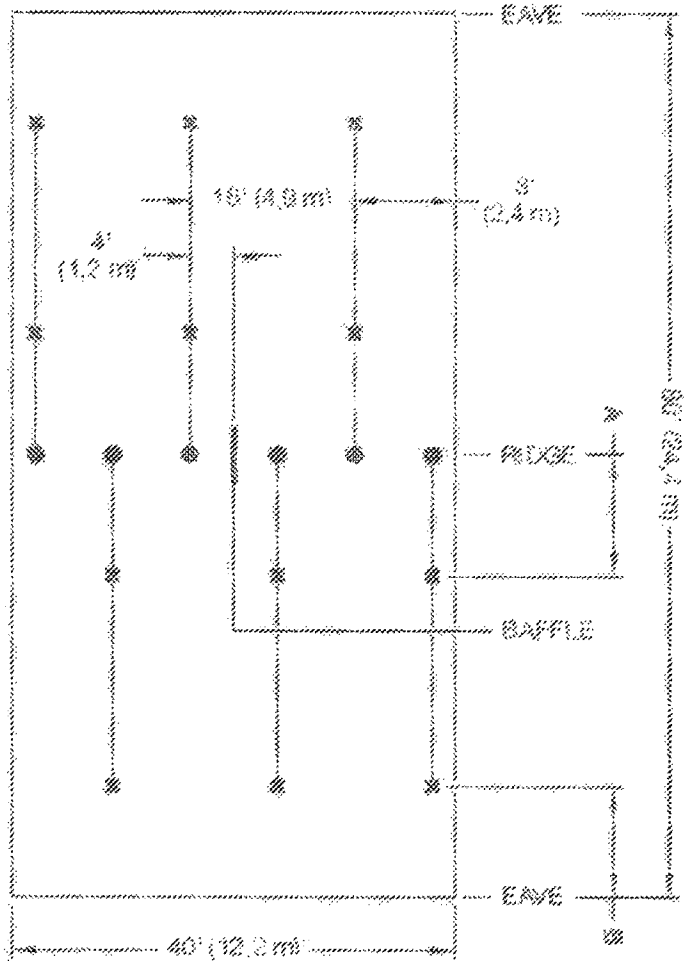
Figure 7G:
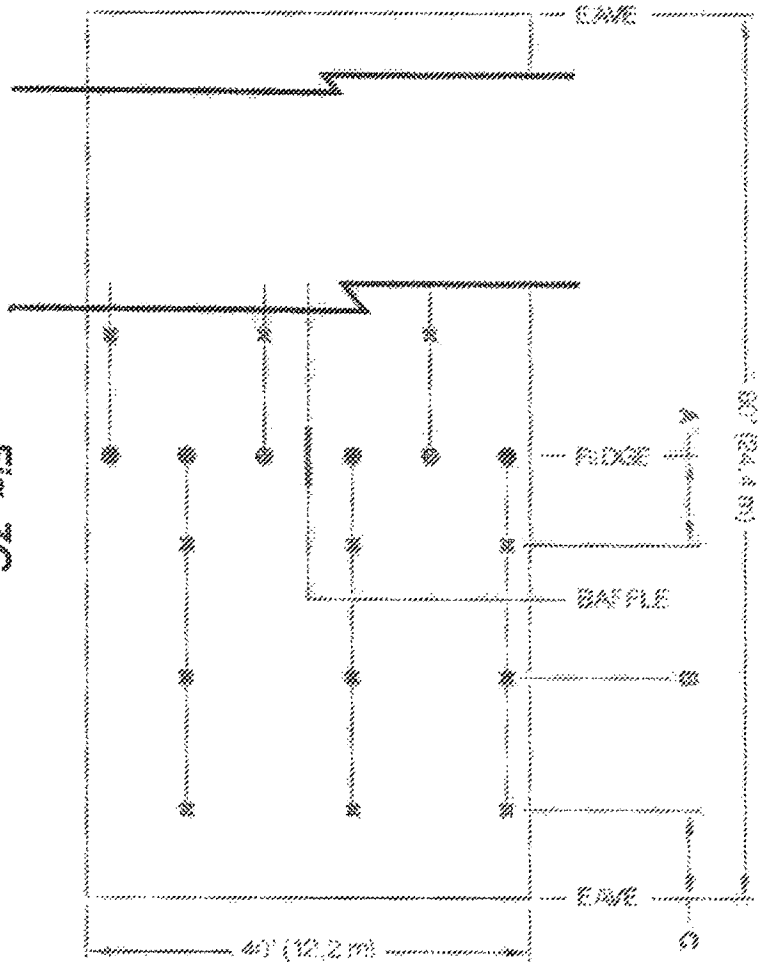

As previously noted, each fluid distribution device 30 of the preferred sectional systems described herein can be embodied as an open fire protection sprinkler, a fire protection nozzle or any other fluid carrying open conduit capable of dispersing firefighting fluid. Depending upon its type, the device 30 can include a fluid deflector or diffuser to define a coverage area of the device 30. The deflector or diffuser can be of any configuration or geometry provided the deflector can deliver a desired fluid distribution and density fix the preferred installation location in order to provide the sectional protection of the attic space. The sprinkler can be configured for either an upright installation or a pendent installation. A preferred fluid distribution device embodied as an open frame fire protection sprinkler 500 is shown in FIGS. 6A and 6B. The sprinkler 500 includes a frame 510 having an inlet 512, and has a preferred nominal K-Factor of 11.2 GPM/(PSI)$^{1/2}$ or less, such as for example, a nominal K-Factor of 11.2 GPM/(PSI)$^{1/2}$ or 4.2 GPM/(PSI)$^{1/2}$. The discharge coefficient or K-factor characterizes the geometry of the passageway 516 and more particularly the orifice diameter O, which defines the flow rate from the sprinkler body. Industry accepted standards, such as for example, the National Fire Protection Association (NFPA) standard entitled, "NFPA 13: Standards for the Installation of Sprinkler Systems" (2013 ed.) ("NFPA 13") provide for a rated or nominal K-factor or rated discharge coefficient of a sprinkler as a mean value over a K-factor range. The K-factor is defined as a constant representing the discharge coefficient that is quantified by the flow of fluid in gallons per minute (GPM) from the outlet of the frame body divided by the square root of the pressure of the flow of fluid fed into the inlet of the frame passageway in pounds per square inch (PSI). The K-factor is expressed as GPM/(PSI)$^{1/2}$. For example for a K-factor of 11.2 or less, the following nominal K-factors (with the K-factor range shown in parenthesis) are: (i) 11.2 (10.7-11.7) GPM/(PSI)$^{1/2}$; (ii) 8.0 (7.4-8.2) GPM/(PSI)$^{1/2}$; (iii) 5.6 (5.3-5.8) GPM/(PSI)$^{1/2}$; (iv) 4.2 (4.0-4.4) GPM/(PSI)$^{1/2}$; (v)) 2.8 (2.6-2.9) GPM/(PSI)$^{1/2}$; and (vi) 1.9 (1.8-2.0) GPM/(PSI)$^{1/2}$; or 1.4 (1.3-1.5) GPM/(PSI)$^{1/2}$. For the preferred sprinkler system 200 and the nominal K-factor of 11.2, the sprinkler has a preferred minimum operating pressure of thirteen pounds per square inch (13 PSI) to provide for a flow rate of forty gallons per minute (40 GPM). Alternate embodiments of the fluid distribution device 30 can include an open frame defining a nominal K-Factor of 11.2 or greater. For a K-factor of 11.2 or greater, the following nominal K-factors (with the K-factor range shown in parenthesis) are: (i) 11.2 (10.7-11.7) GPM/(PSI)$^{1/2}$; (ii) 14.0 (13.5-14.5) GPM/(PSI)$^{1/2}$; (iii) 16.8 (16.0-17.6) GPM/(PSI)$^{1/2}$; (iv) 19.6 (18.6-20.6) GPM/(PSI)$^{1/2}$; (v) 22.4 (21.3-23.5) GPM/(PSI)$^{1/2}$; (vi) 25.2 (23.9-26.5) GPM/(PSI)$^{1/2}$; (vii) 28.0 (26.6-29.4) GPM/(PSI)$^{1/2}$; and (viii) 33.6 (31.8-34.8) GPM/(PSI)$^{1/2}$. Alternate embodiments of the fluid distribution device 30 can include sprinklers having the aforementioned nominal K-factors or greater.

An appropriately sized fluid control thermal detection device 20 delivers firefighting fluid at a preferred minimum operating pressure, such as for example 13 PSI, to a fluid distribution device 530 having an appropriately sized orifice or discharge coefficient, such as for example, K-Factor 11.2 GPM/(PSI)$^{1/2}$, to impact the deflector 518 and provide for a preferred coverage area of up to 400 square feet. The deflector member 518 is preferably configured the same as the deflector of the Model AP with 4.2 or 5.6 K-Factor Specific Application Combustible Concealed Space Sprinklers from Tyco Fire Products LP, shown and described in technical data sheet TFP610 entitled, "Model BB, SD, HIP, and AP 'Specific Application Sprinklers For Protecting Attics" (December 2007).

Exemplary fire protection sprinklers for use in the preferred sectional fire protection systems 10 can also include known standard spray sprinklers, specific application attic sprinklers or other specific application sprinklers in their open or unsealed configuration. In particular, preferred known fire protection sprinklers for use in the sectional fire protection system can include: (i) the Model AP with 4.2 or 5.6 K-Factor Specific Application Combustible Concealed Space Sprinklers; or (ii) the Model WS Specific Application Window Sprinkler from Tyco Fire Products LP, shown and described in technical data sheet TFP620 entitled, "Model WS Specific Application Window Sprinklers Horizontal and Pendent Vertical Sidewall 5.6 K-factor" (May 2014). Any preferred open sprinkler frame and its deflector installed in a preferred sectional fire protection system described herein can be appropriately oriented with respect to the ceiling base C and/or roof deck to provide for the preferred fluid density over an appropriately sized and more preferably maximized coverage area at the preferred minimum operating pressure. Other known open frame fire protection sprinklers, nozzles and/or their fluid distribution components can be identified for use in a preferred sectional fire protection system by examination of its fluid distribution and/or its performance in appropriate fire testing to effectively address a fire and deliver a preferred fluid distribution density when coupled to an appropriate fluid control thermal detection device. Another fluid distribution device for use in systems described herein can include the nozzles shown and described in U.S. Pat. No. 4,585,069.

Shown and described with respect to FIGS. 7A-16C are various embodiments of systems for the protection of attic spaces beneath conventional and complex roof configurations, including systems that use only deluge sub-systems in accordance with the present disclosure. In some embodiments, the deluge sub-systems provide attic space protection for large attic spans, e.g., over forty feet (40 ft.) and in some embodiments up to a maximum span of eighty feet (80 ft.). As described below, whole sections of an attic space can be protected by only the deluge sub-systems, such as by using Model AP 4.2 or 5.6 K-Factor Specific Application Combustible Concealed Space Sprinklers or alternatively using nozzles as shown, described or substantially configured in U.S. Pat. No. 4,585,069. In some embodiments, the Model AP sprinklers are installed to locate the deflectors one to four inches below the bottom of the top chord or bottom of solid wood rafter on the same pitch as the respective rood above the sprinkler. For systems using the Model AP 4.2 or 5.6 K-Factor Specific Application Combustible Concealed Space Sprinklers, the sprinklers can be provided with water or firefighting fluid with a minimum flow per sprinkler respectively of 12 GPM and 16 GPM. The systems shown and described provide a distribution fluid density ranging from 0.05-0.1 GPM/SQ. FT., and in some embodiments, ranges from 0.05 GPM/SQ. FT. to less than 0.1 GPM/SQ. FT., for example fluid density ranging from 0.073 GPM/SQ. FT. to 0.080 GPM/SQ. FT., and in some embodiments, 0.05 GPM/SQ. FT. The total number of fluid distribution devices and the respective operative flow for each distribution device can define the total fluid demand for the sectional protective system. For the sectional attic fire protection systems described herein, the total fluid flow system demand can be 150 GPM or less.

Shown in FIGS. 7A-7G are various embodiments of a system 600 having multiple deluge sub-systems 610 in a preferred alternating arrangement for the protection of an attic space section of varying spans S, e.g., 20 ft., 40 ft., 60 ft. and 80 ft. and lengths L beneath a gabled roof R. The system 600 protects the area using the deluge sub-systems (e.g., responsive to detecting a fire condition, the system 600 actuates the deluge sub-systems), and in some embodiments, a deluge fire protection system for the protection of an attic space section defined by a ceiling base C defining a span S of no more than eighty feet (80 ft.) and a roof deck R1, R2 sloped above the ceiling C to form a ridge line formation RD centered above the ceiling base C and a peak region P of the attic space proximate the ridge line RD with two eave regions E disposed about the ridge line RD. The attic space ATTIC having a first end AE1 and a second end AE2 spaced apart from the first end AE1 along the ridge line RD to define a length L of the attic section ATTIC with one or more baffles BA between the first and second end AE1, AE2 disposed perpendicular to the ridge line RD TO define two or more baffled regions BR1, BR2 of the attic space. The spacing in the direction of the ridge line RD between baffles BA or between a baffle and an end AE of the attic space ATTIC defines the length BL of the baffled region BR.

As shown in the arrangement of the system 600 in FIG. 7C-7G, two baffled regions BR1, BR2 can be protected by no more than six deluge sub-systems 610 aligned along the ridge formation proximate the peak region P. Each deluge sub-system 610 can include one fluid control thermal detection device 620 and no more than three fluid distribution devices 630 pipe connected with the one fluid control thermal detection device 620. The fluid distribution devices 630 can be axially aligned and spaced apart from one another between the ridge line RD and one of the eave regions E in a direction perpendicular to the ridge line RD. The axial alignment of the fluid distribution devices 230 of adjacent deluge sub-systems 610 are oppositely directed about the ridge line RD toward one of the eave regions E to define the preferred alternating arrangement. In some embodiments, the total number of fluid distribution devices of the system 600 tier protection of two baffled regions BR1, BR2 consists of no more than eighteen open fluid distribution devices.

Figure 8A:
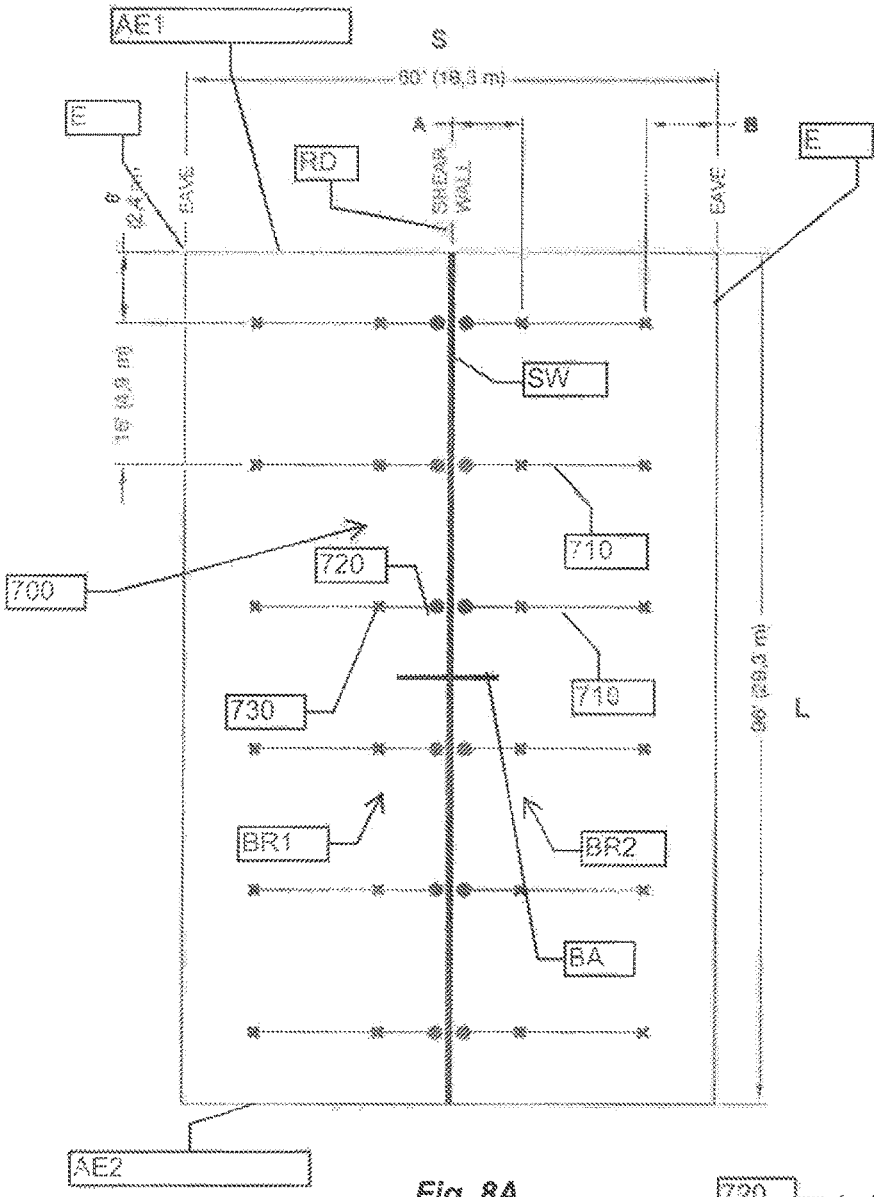
FIGS. 8A-8B schematically shows various views of another preferred embodiment of an attic fire system having deluge sub-systems.
Figure 8B:
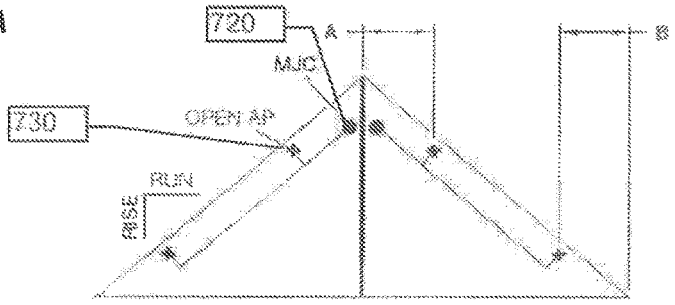
Figure 9A:
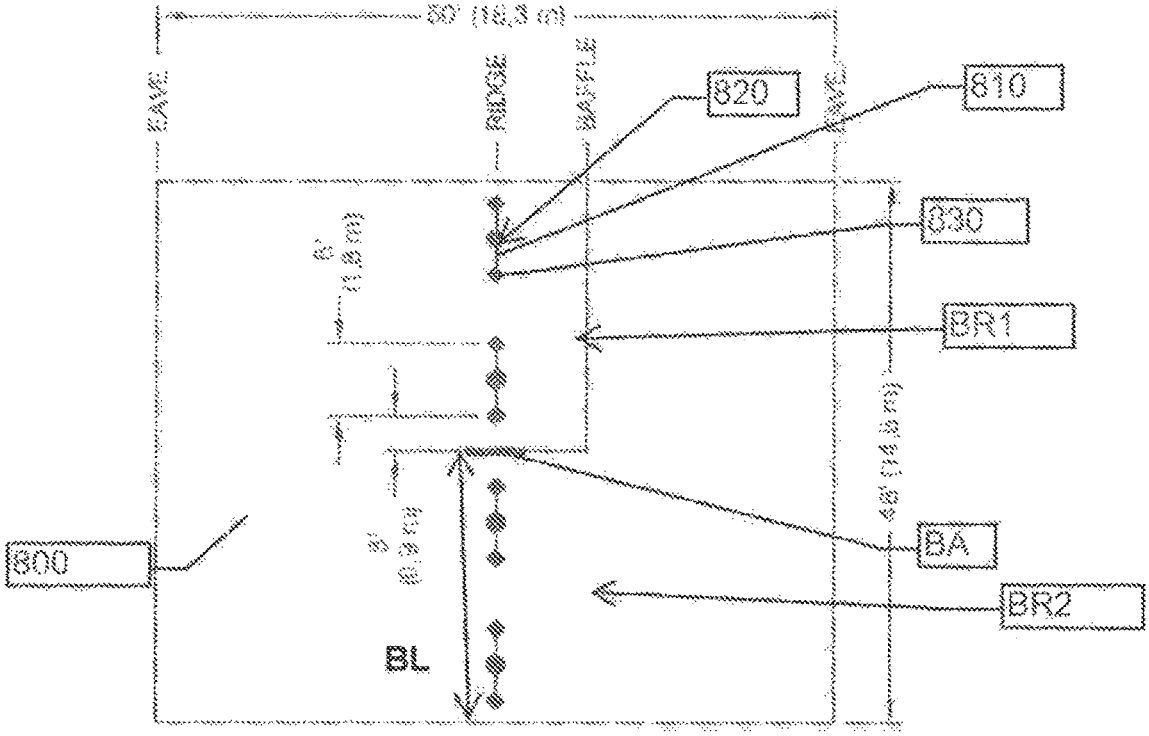
FIGS. 9A-9D, 10A-10B and 11A-11B schematically shows various views of another preferred embodiment of an attic fire system having deluge sub-systems FIGS. 12A-12B and 13A-13B schematically show various constructions and views of HIP-type roofs.
Figure 9B:
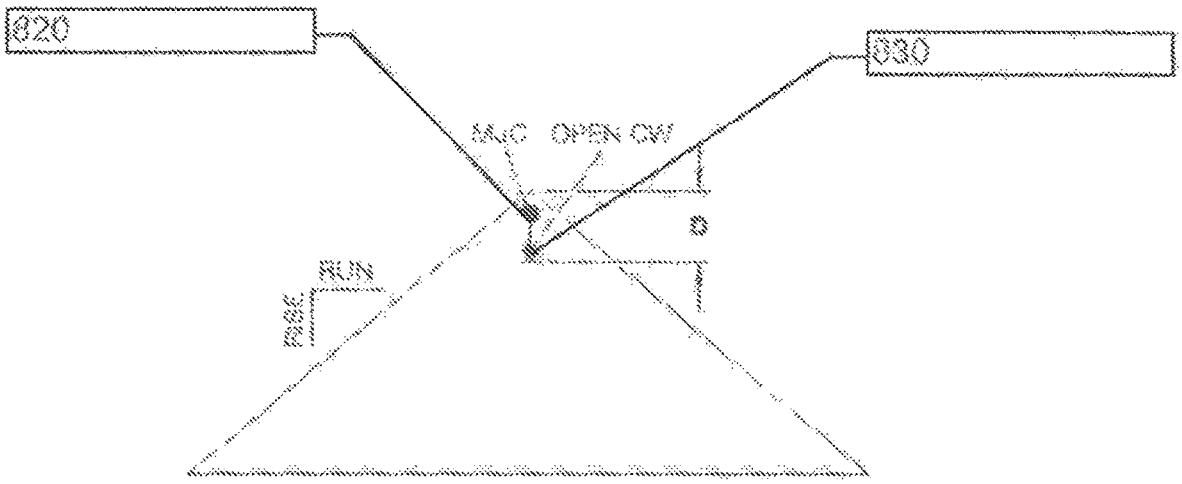
Figure 9C:
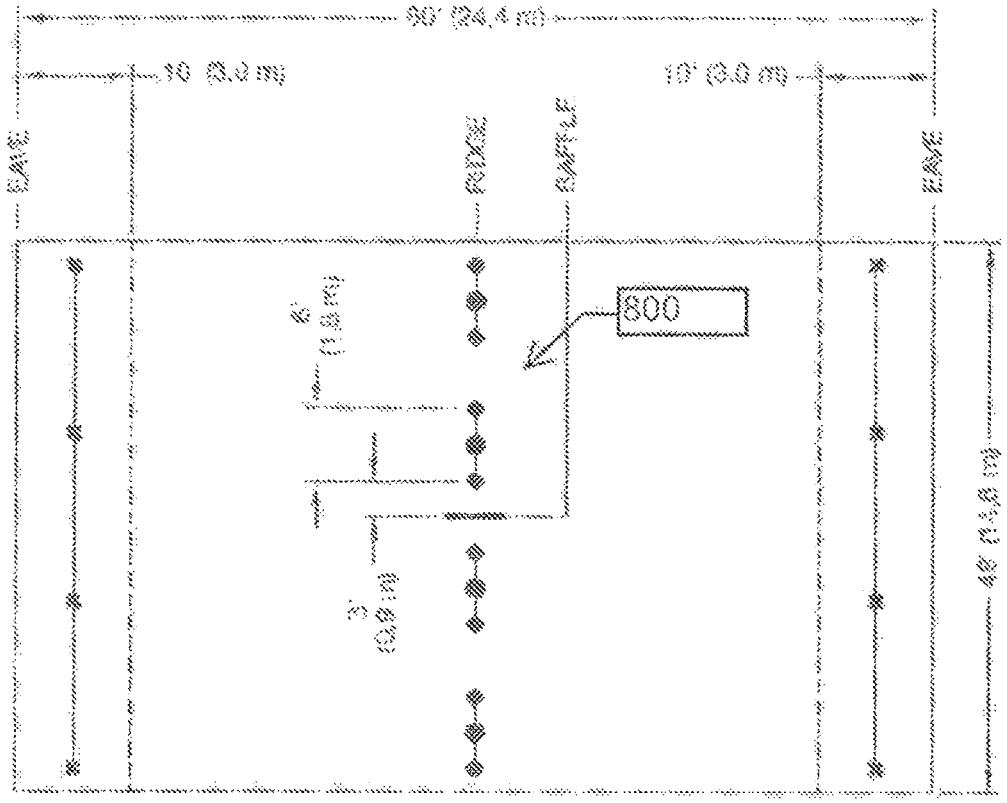
Figure 9D:
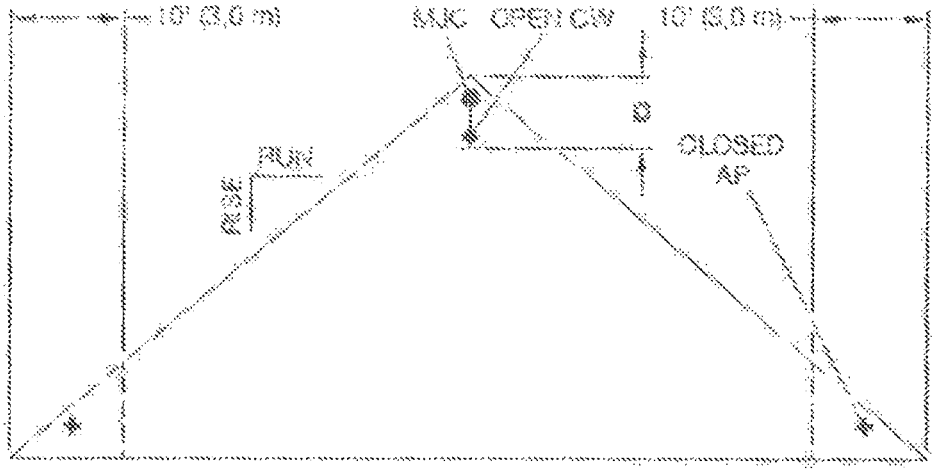

Shown in FIGS. 8A-8B is a system 700 for the protection of the attic spaces previously described, and which, in some embodiments, are defined or divided by a shear wall SW extending along the ridge line formation RD. The attic space has a first end AE1 and a second end AE2 spaced apart from the first end along the ridge line to define a length of the attic section ATTIC with at least one shear wall SW extending from the roof deck R to the ceiling base C between the first and second ends AE1, AE2 disposed parallel to the ridge line RD to define baffled regions BR1, BR2 of the attic space. The attic space ATTIC can be protected only by deluge sub-systems 710 in which each deluge sub-system 710 includes, in some embodiments, one fluid control thermal detection device 720 located proximate a peak region P defined by the intersection of the shear wall SW and the ridge line formation RD. In some embodiments, no more than two fluid distribution devices 730 are pipe connected with the one fluid control thermal detection device 730 of a given deluge sub-system 710. The deluge sub-systems 710 can be axially aligned or disposed in a direction perpendicular to the ridge line RD. Unlike the previously described alternating arrangement, deluge sub-systems 710 opposed about the shear wall are aligned with one another. In the protection of two baffled regions BR1, BR2, the system 700 can include no more than twelve fluid control thermal detection devices 720 with no more than six fluid control thermal detection devices 720 disposed to one side of the shear wall SW. Accordingly, in some embodiments for the number of deluge sub-systems 710, no more than twenty-four open fluid distribution devices 730 with no more than twelve fluid distribution devices 730 are disposed to one side of the shear wall SW. Again, the system 700 can provide deluge sub-system only protection for the attic space. In some embodiments (not shown), the attic space section ATTIC is divided along its length by a pair of parallel shear walls SW in which the interior space between can be protected by automatic standard spray sprinklers and the baffled regions BR outside of the interior space can be protected by deluge sub-systems 710 previously described.

In each of the systems 600, 700, the baffled region length BL can define or determine the number of fluid control thermal detection devices 620, 720 to protect the baffled region BR. The following factors can define or determine the number of fluid control thermal detection devices 620, 720: (i) where the baffled region length DL ranges from 0-8 ft., the number of fluid control thermal detection devices protecting the baffled region is one; (ii) where the baffled region length BL ranges from greater than 8 ft.-16 ft., the number of fluid control thermal detection devices protecting the baffled region is two; and (iii) where the baffled region length BL ranges from greater than 16 ft.-24 ft., the number of fluid control thermal detection devices protecting the baffled region is three. As to the spacing of the fluid controlled thermal detection devices 620, 720, the fluid control thermal detection device can be spaced four feet from the baffle BA; and where there are two or more fluid control thermal detection devices within the baffled region BR, the devices can be spaced eight feet from one another.

In some embodiments, the span S of the attic space ATTIC defines the lateral spacing of the fluid distribution devices 620, 720. For example, where the span ranges from twenty to forty feet and the deluge sub-systems 610, 710 has only one fluid distribution device 630, 730 laterally off-set from the fluid control thermal detection device 610, 710 at a distance ranging from four to ten feet (4-10 ft.). In some embodiments, such as where the span S is twenty feet (20 ft.), the one fluid distribution device is laterally off-set from the fluid control thermal detection device at a distance ranging from four to six feet (4-6 ft.). In some embodiments, such as where the span S is forty feet (40 ft.), the one fluid distribution device is laterally off-set from the fluid control thermal detection device at a distance ranging from eight to ten feet (8-10 ft.). For larger spans ranges from forty to eighty feet (40-80 ft.) in which each deluge sub-systems 610,710 of the system has two or more fluid distribution devices laterally off-set from the fluid control thermal detection device, a first fluid distribution device can be laterally spaced at a distance ranging from seven to twelve feet (7-12 ft.) from the fluid control thermal detection device and a second fluid distribution device can be laterally spaced at a distance ranging from 7-12 ft. from an eave region E. For a system that includes a third fluid distribution device, the fluid distribution device 630, 730 can be disposed between the first and second fluid distribution device.

Shown in FIGS. 9A-10B (see also FIGS. 11A-11B) are embodiments of a system 800 using open nozzles or sprinklers with curved elongated deflectors. The system 800 includes a plurality of fluid control thermal detection devices 820 which can include no more than six fluid control thermal detection devices aligned along below the ridge formation RD coupled to one or more fluid distribution devices 830. In some embodiments, the system 800 can protect two baffled region BR1, BR2, and the plurality fluid distribution devices 830 preferably consists no more than twelve and more preferably no more than eight open fluid distribution devices 830 each coupled to one of the plurality of fluid control thermal detection devices 820 to define no more than six and more preferably no more than four sectional deluge sub-systems spaced apart from another. In some embodiments, each deluge sub-system 810 consists of one fluid control thermal detection device 820 and no more than two fluid distribution devices 830 pipe connected with the one fluid control thermal detection device 820 that is axially aligned and spaced apart from one another in a direction aligned with the ridge line RD at a preferred axial distance of six feet (6 ft.). In some embodiments, the system 800 protect the attic space with only deluge sub-systems. Shown in FIGS. 9C-9D an embodiment of the system 800 used in combination with automatic sprinklers, such as automatic Model AP sprinklers, positioned within the eave regions E.

Figure 10A:
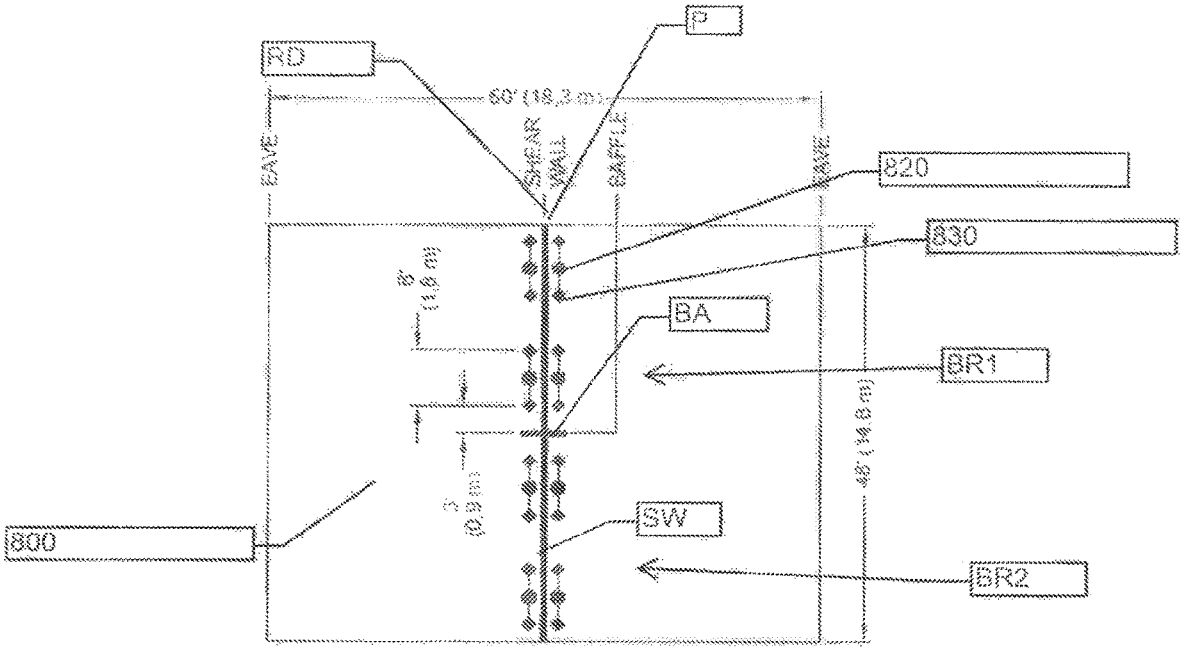
Figure 10B:
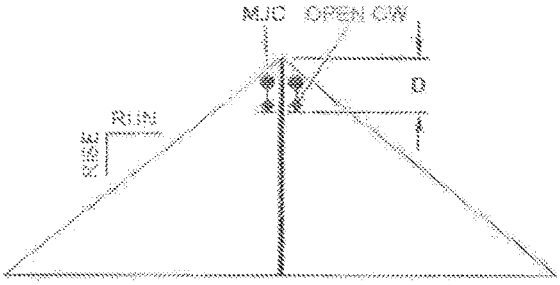
Figure 11A:
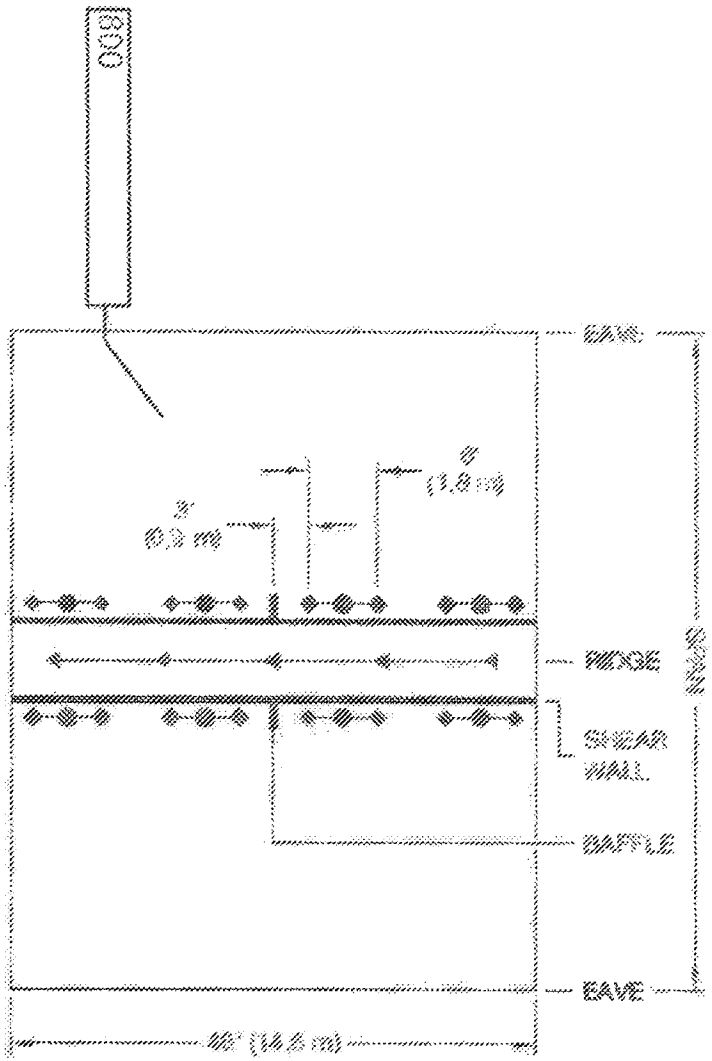
Figure 11B:
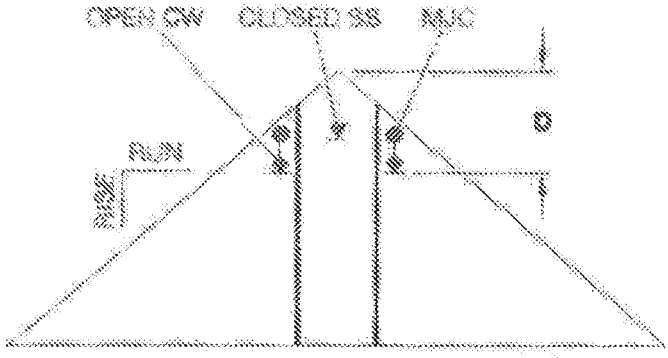
Figure 12A:
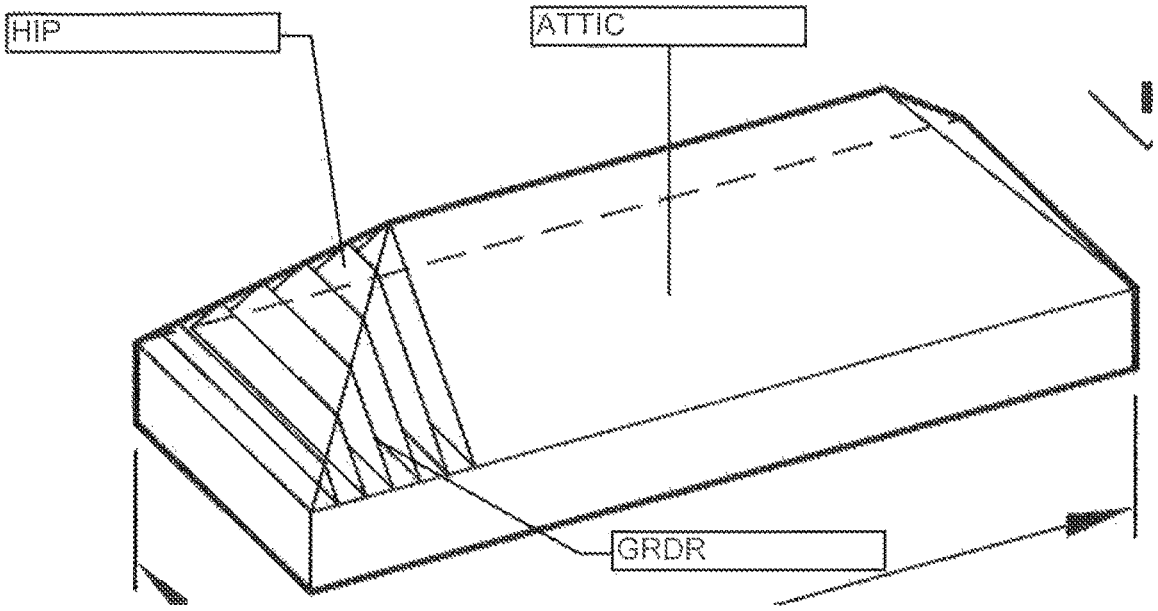
Figure 12B:
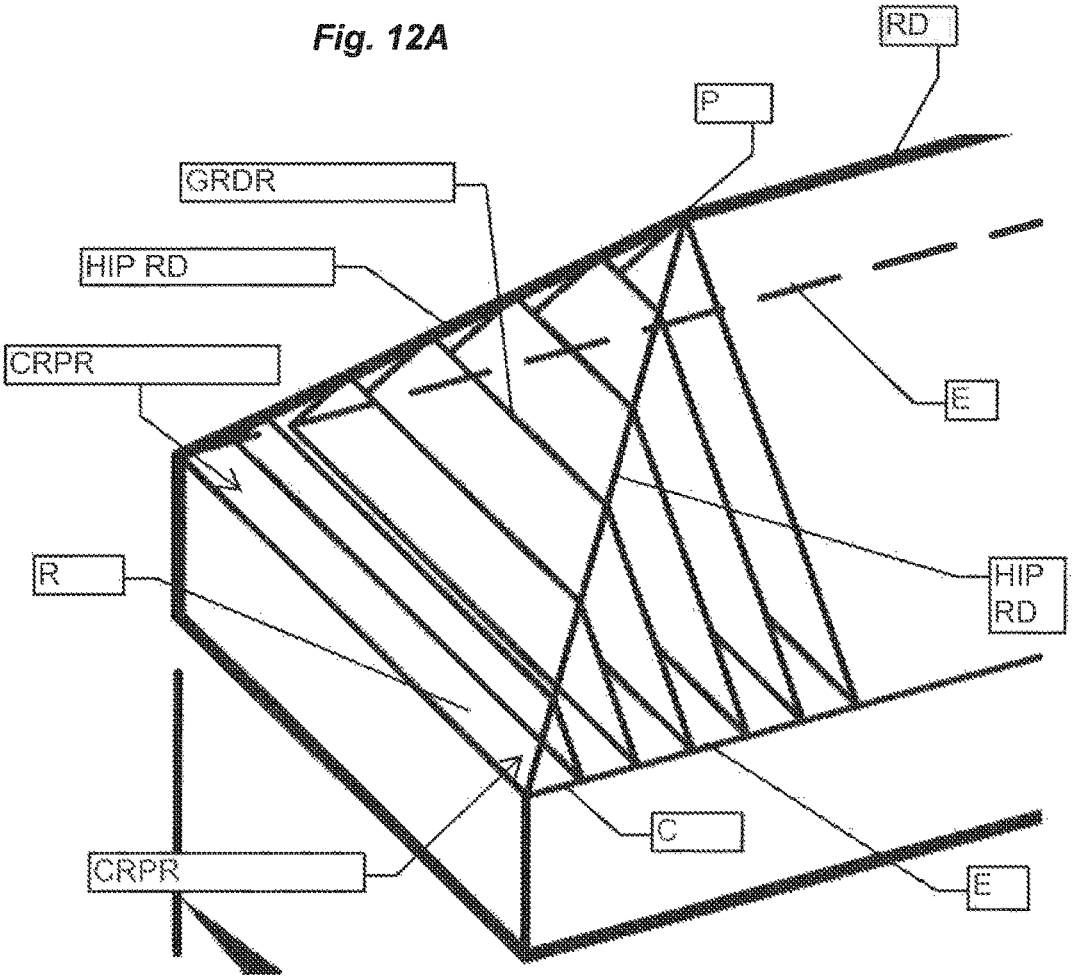
Figure 13A:
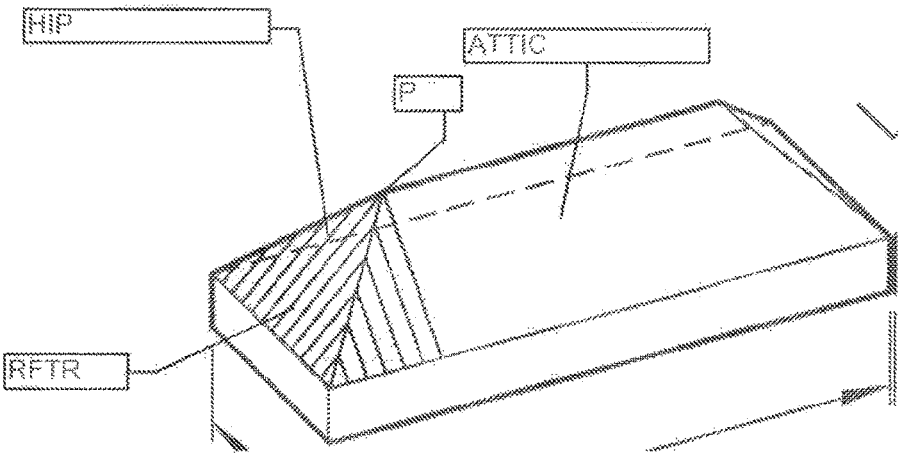
Figure 13B:
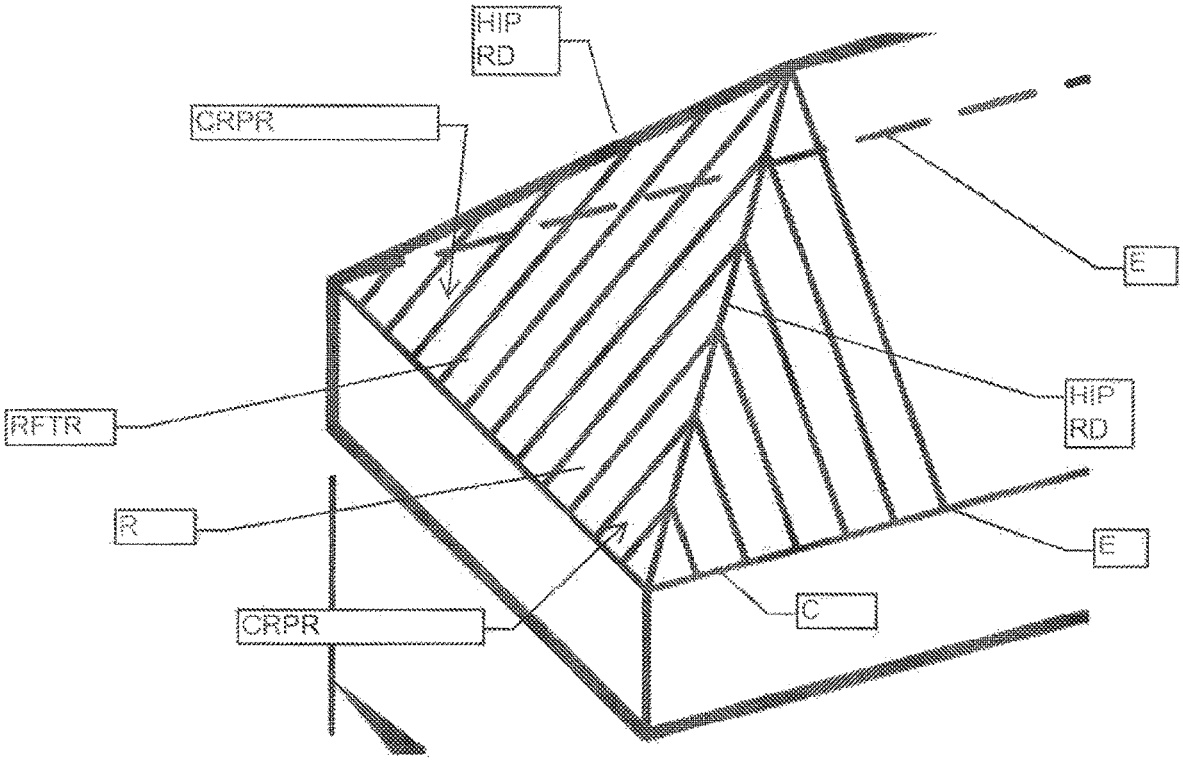

Shown in FIGS. 10A-10B are embodiments of the system 800 that can protect an attic space section ATTIC with at least one shear wall SW extending from the roof deck to the ceiling base between the first and second ends disposed parallel to the ridge line to define at least two baffled regions of the attic space. In protecting two baffled regions BR1, BR2, the system 800 includes no more than six and, in some embodiments, no more than four sectional deluge sub-systems 810 spaced apart from the first end to the second end and disposed to one side of the at least one shear wall SW for the protection of one of the at least two baffled regions BR1, BR2.

In the system 800, the baffled region length BL can define or determine the number of fluid control thermal detection devices 820 and number of fluid distribution devices 830 to protect the baffled regions BR1, BR2. The following factors can define or determine the number of fluid control thermal detection devices 820 and number of fluid distribution devices 830: (i) where the baffled region length BL ranges from 0-16 ft., the number of fluid control thermal detection devices is one and the number of fluid distribution devices is one to protect the baffled region BR; (ii) where the baffled region length BL ranges from greater than 16 ft.-32 ft., the number of fluid control thermal detection devices is one and the number of fluid distribution devices is two to protect the baffled region BR; (iii) where the baffled region length BL ranges from greater than 32-48 ft., the number of fluid control thermal detection devices is two and the number of fluid distribution devices is three to protecting the baffled region BR; and (iv) where the baffled region length BL ranges from greater than 48 ft.-64 ft., the number of fluid control thermal detection devices is two and the number of fluid distribution devices is four to protect the baffled region BR.

Shown in FIGS. 12A-12B and 13A-13B are illustrations of a main pitched or saddled roof with a HIP type roof end defining a HIP region or section of the attic space ATTIC to be protected. The HIP type roof can be supported by truss framing or girders GRDRs that extend parallel to the outside end wall of the HIP region as schematically seen for example in FIGS. 12A-12B. Alternatively, the HIP type roof can be supported by rafters RFTRS that extend perpendicular to the outside endwall as schematically seen for example in FIGS. 13A-13B. Further in the alternative, the HIP type roof can be constructed with a combination of truss or girder GRDR framing and rafters RFTRs that respectively extend parallel and perpendicular to the outside wall of the HIP region. Generally, the HIP type roof includes two lateral roof decks that are angled with respect to a central roof deck to define two HIP ridge lines HIP RD. The three roof decks are sloped to intersect one another and the ridge line formation RD of the main roof to define a peak region P. The slope of central roof deck of the HIP type roof can vary to define a slope of any one of 2:12 or greater, preferably 4:12 or greater such as, for example, 8:12, 10:12 and even more preferably 12:12. Regardless of the construction of the HIP type roof, the angle and intersection of the roof decks R with the ceiling base C can present low clearance areas which can present a challenge for fluid distribution and wetting in fire protection. For example, the HIP type roof and its intersection with the ceiling base define corners of the HIP region that are contiguous with the eaves E of the structure. As seen in each of FIGS. 12B and 13B, the HIP region includes two creeper corner regions CRPR contiguous with the eave regions and the outer wall of the HIP region. It will be appreciated that the present solution can address difficulties in effectively supplying fluid to protect HIP type roof regions, which typically have challenging geometries as discussed herein.

Figure 14:
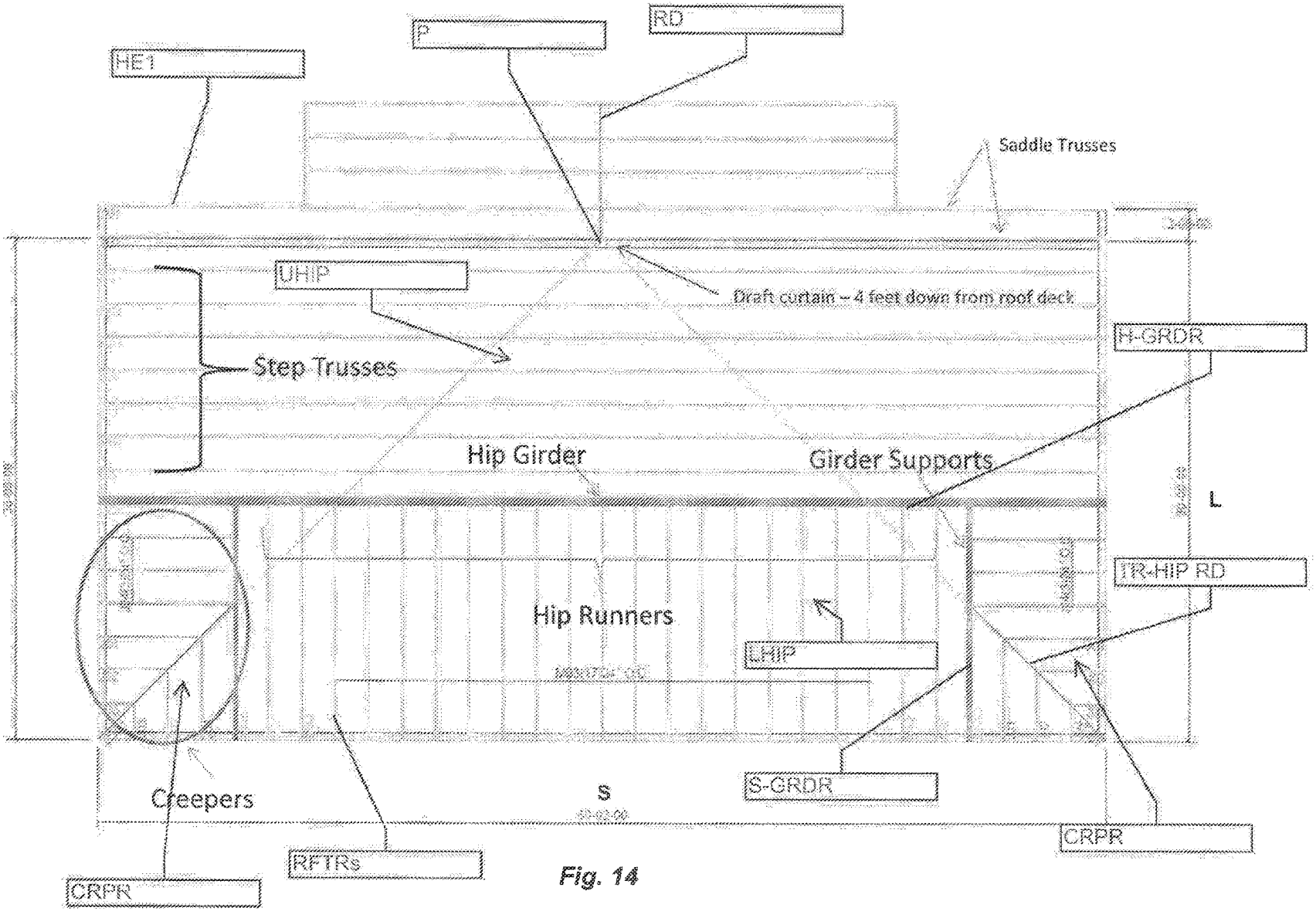
FIG. 14 is a schematic plan view of a particular HIP section.
Figure 15A:
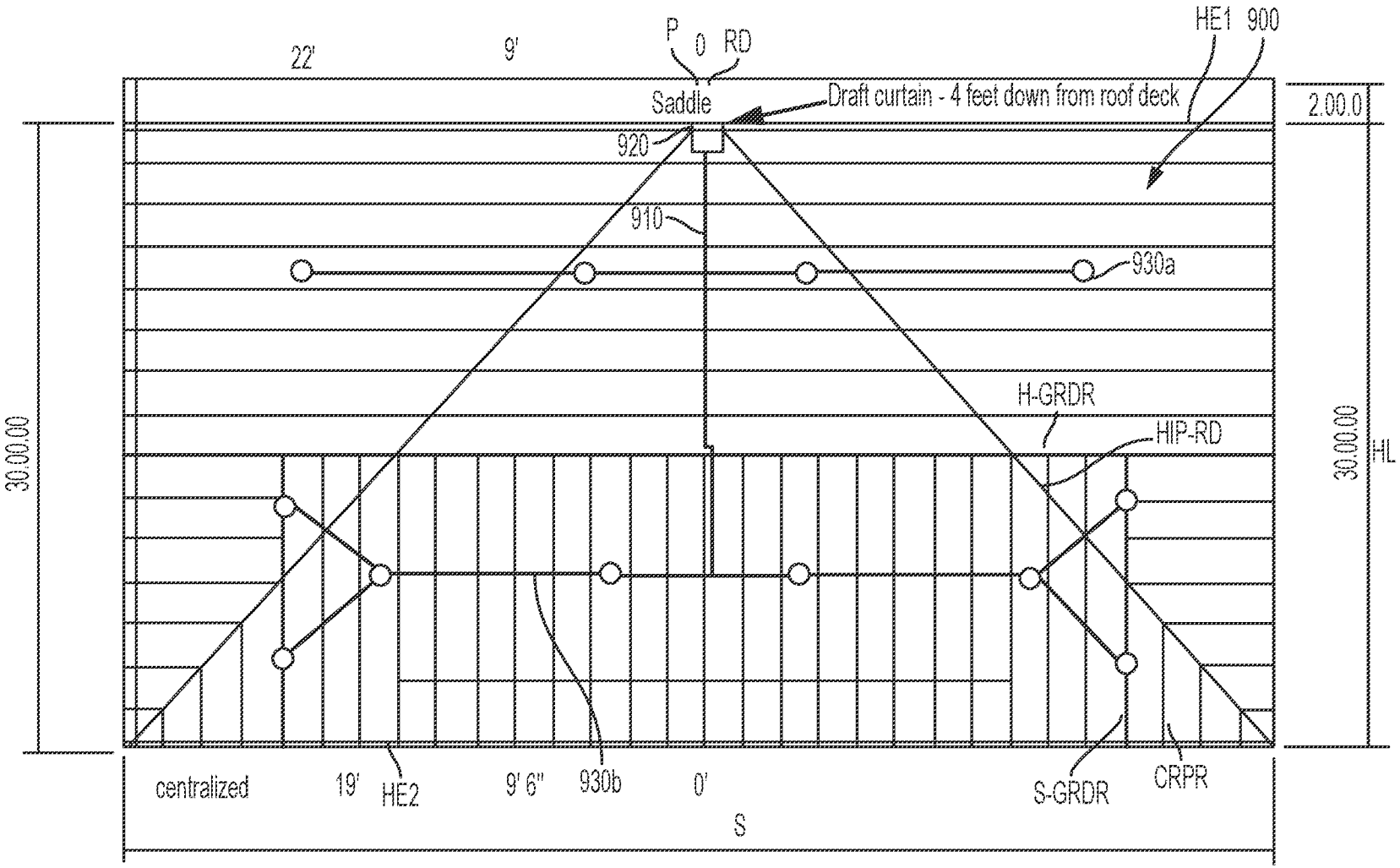
FIGS. 15A-15B are schematic plan views of various preferred attic protection systems for use in the HIP section of FIG. 14.
Figure 15B:
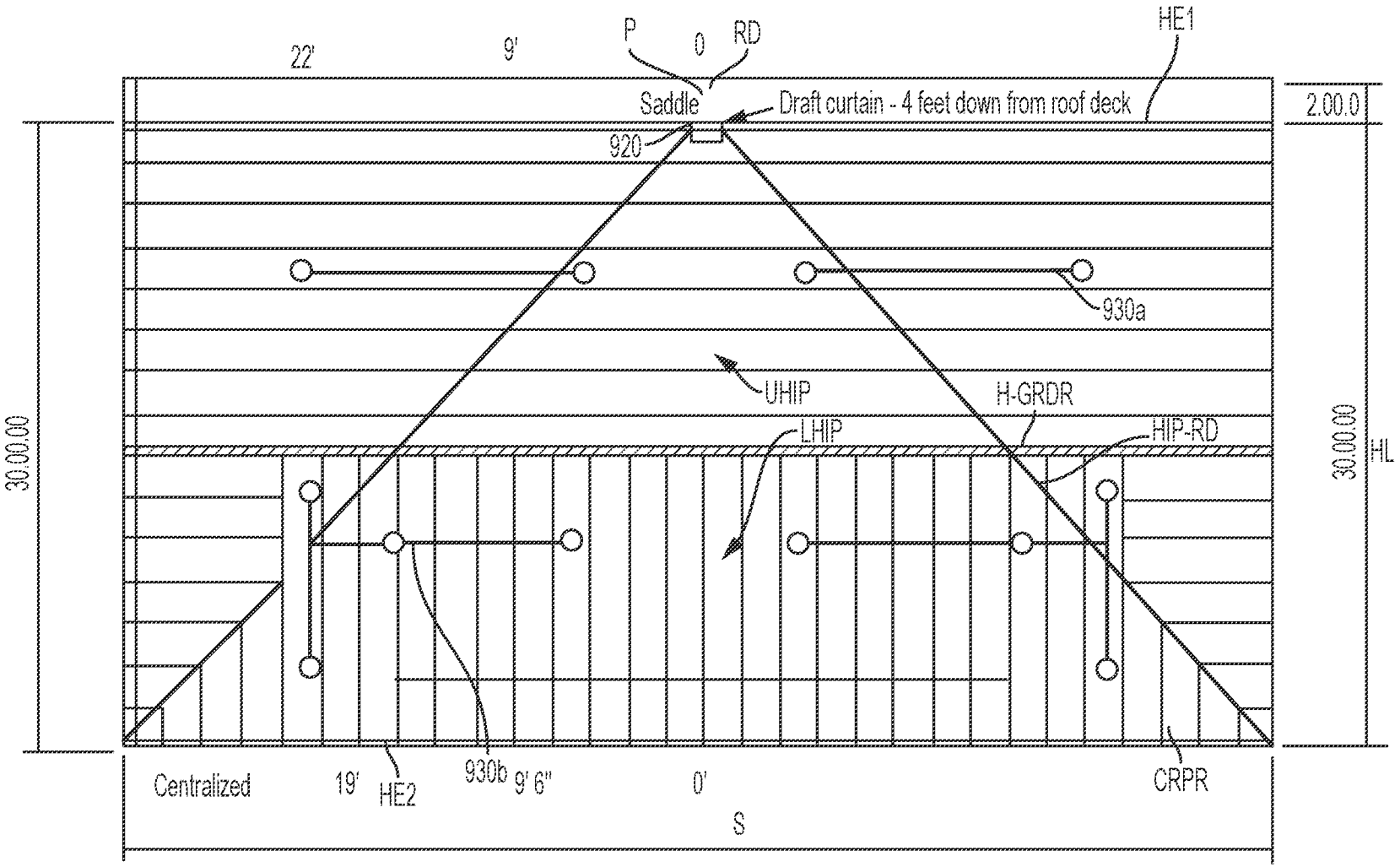

Shown in FIGS. 15A-15B and 16A-16C, are embodiments of a deluge fire protection system 900 that can protect a particular HIP end section of an attic space section shown in FIG. 14, in some embodiments using only one or more deluge sub-systems. The attic space is defined by a ceiling base having a span of no more than eighty feet with a HIP-type roof adjacent a saddled roof having a central ridge line RD with two eave regions E disposed about the ridge line. The HIP end section has a first end HE1 adjacent main roof defined by a truss frame extending perpendicular to the central ridge line formation RD. A first baffle can be aligned along the first end extending at least four feet down from the roof deck to separate the HIP end section from the attic space beneath the main saddled roof. The second end HE2 of the HIP section at the outer wall is defined by the spaced apart rafters which extend parallel to the central ridge RD. The second end HE2 is spaced apart from the first end to define a length HL of the end section. The HIP end section preferably including a second baffle or intermediate HIP girder support H-GRDR extending perpendicular to the central ridge line RD between the first and second ends HE1, HE2 to define an upper HIP section UHIP and a lower HIP section LHIP In the lower HIP end section LHIP includes two creeper corner regions CRPR of the H1P end section. Each creeper corner region CRPR is preferably bound the H1P girder support H-GRDR and a girder support S-GRDR that extends perpendicular to the intermediate HIP girder H-GRDR. Internal supports to the creeper regions include a first group of rafters extending perpendicular to the girder support S-GRDR and a second group of rafters extending parallel to the girder support S-GRDR. Dividing the first and second group of rafters is a truss TR-HIP RD extending along the HIP ridge line HIP RD.

The system 900 includes at least one fluid control thermal detection device 920 aligned along at least one of the HIP ridge lines HIP RD and a plurality fluid distribution devices which, in some embodiments, include no more than eighteen and, in some embodiments, no more than twelve open fluid distribution devices 930, which may be Model AP sprinklers, each coupled to the at least one fluid control thermal detection device 920 to define at least one sectional deluge sub-system 910 for the protection of the HIP end section HIP preferably including its corner creeper regions CRPR. The plurality of fluid distribution devices 930 includes a first group 930*a* disposed above the intermediate baffle or girder H-GRDR for protection of the upper HIP section UHIP and a second group of fluid distribution devices 930*b* disposed beneath the HIP-type roof below the second baffle for protection of the lower HIP section LHIP. The second group includes at least one fluid distribution device disposed above or adjacent each of the creeper corner regions CRPR of the H1P end sections, in some embodiments. The system 900 can protect the HIP region with only deluge sub-systems, such as by using no more than eighteen and in some embodiments no more than twelve fluid distribution devices 930 to provide the fluid density and lower the overall fluid demand.

Figure 16A:
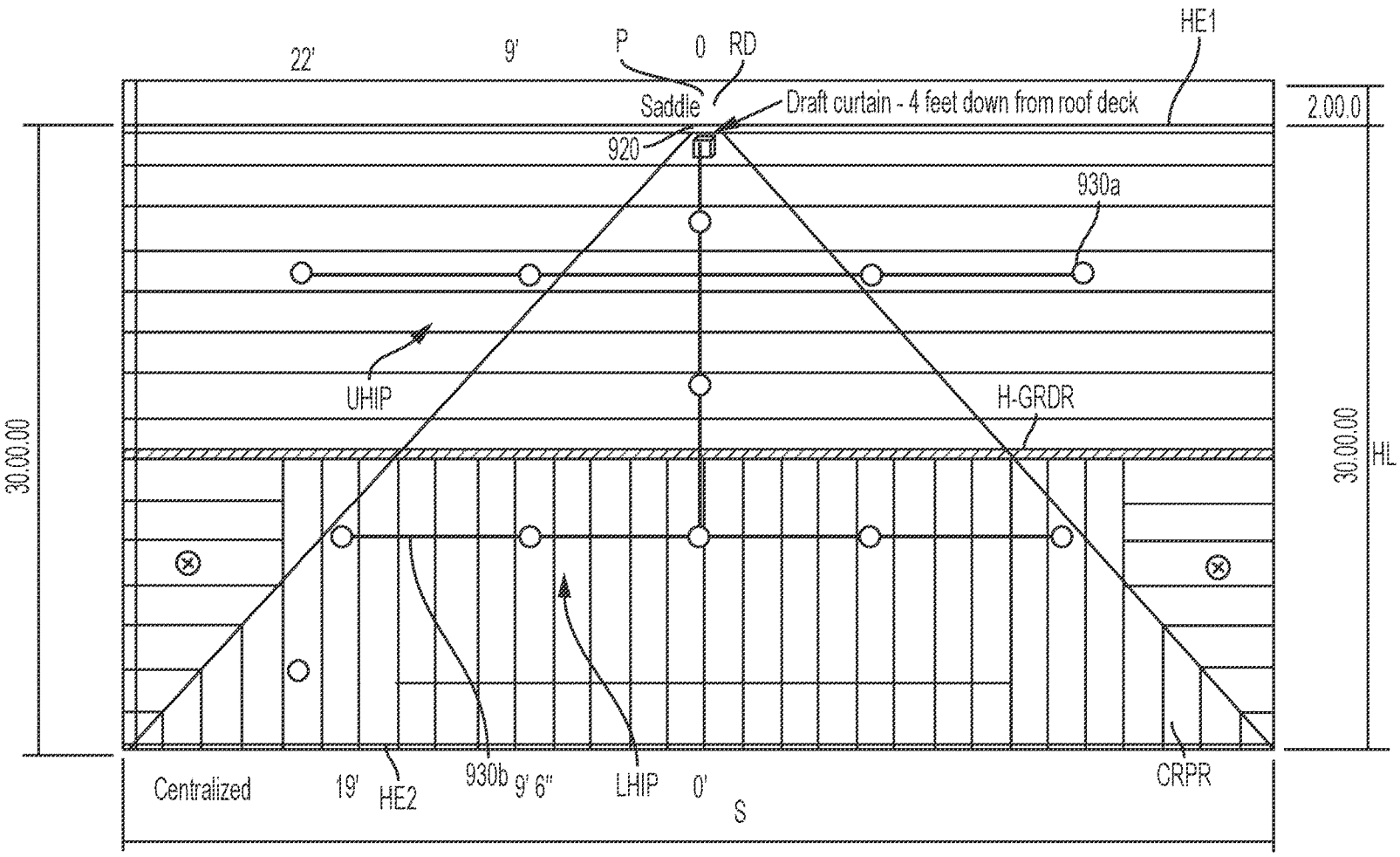
FIGS. 16A-16C are schematic plan views of various preferred attic protection systems for use in the HIP section of FIG. 14.
Figure 16B:
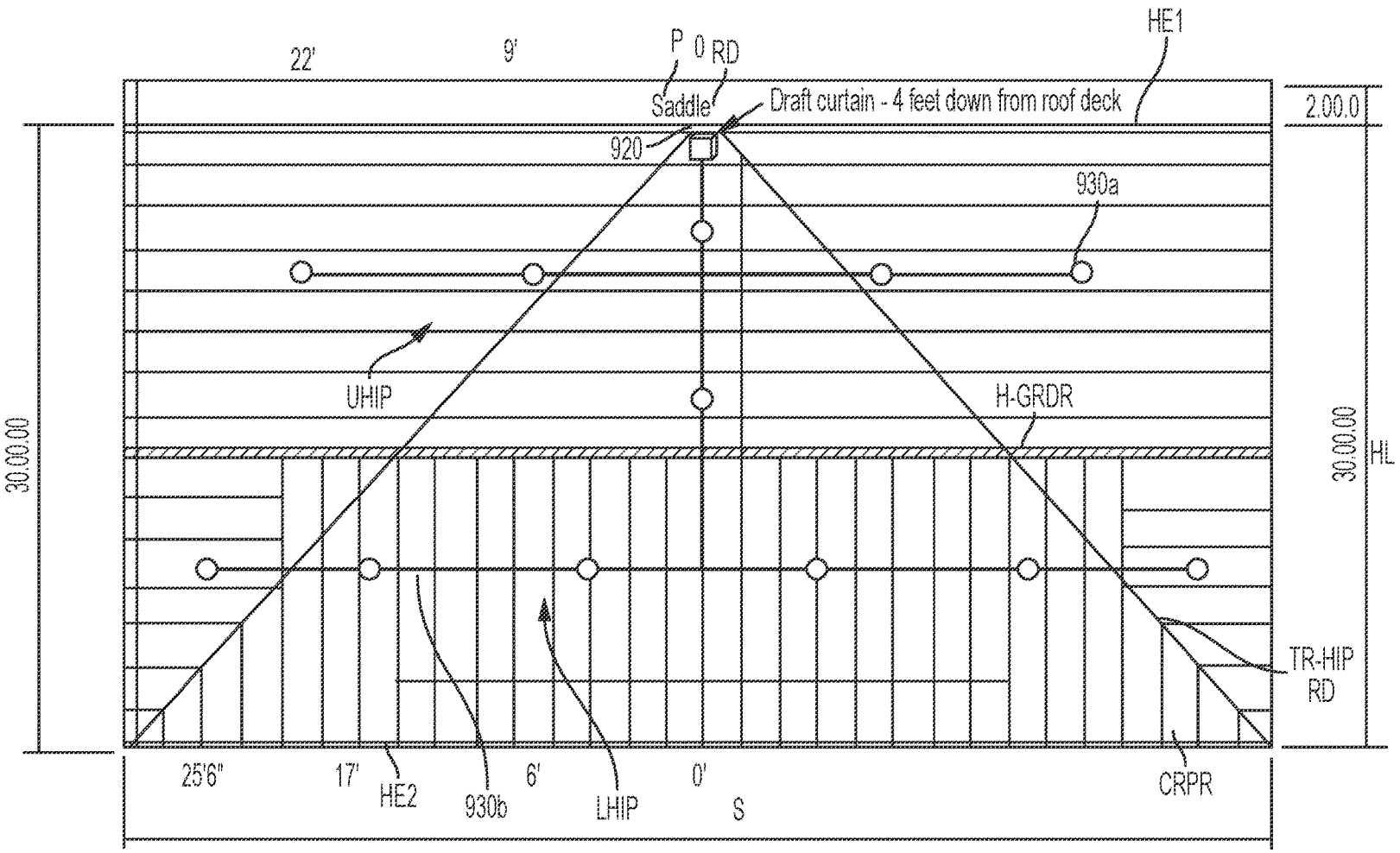
Figure 16C:
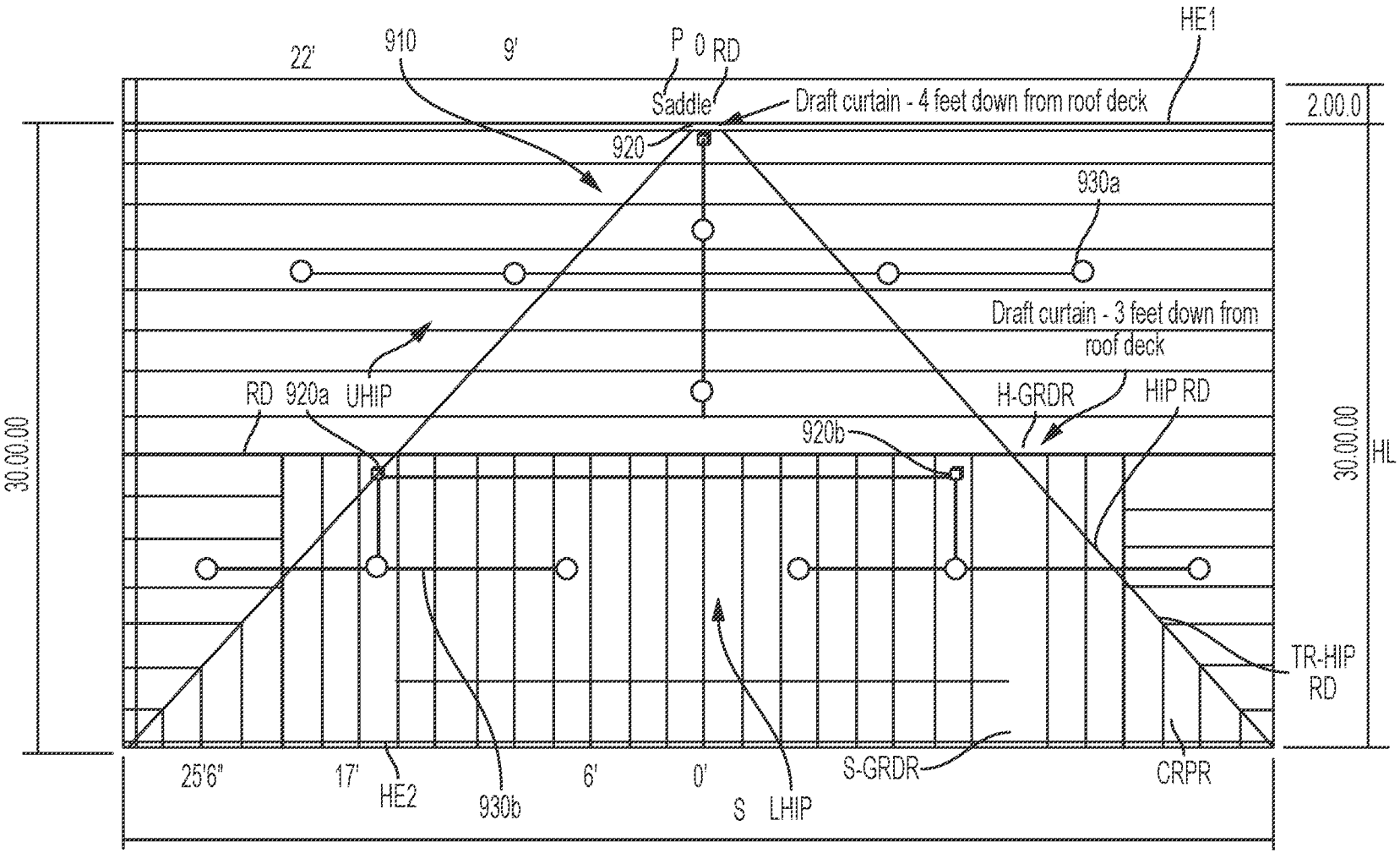

In each of the embodiments of the system 900 shown in FIGS. 15A-15B and 16A-16C, a central fluid control thermal detection device 920 can be located proximate the peak region P at the intersection of the two HIP ridge lines HIP RD and the central ridge line formation RD of the main roof. In embodiments such as shown in FIG. 16C, two lateral fluid control thermal detection devices 920*a*, 920*b* are preferably independently pipe connected to a fluid supply source SRC and located along the HIP ridge lines HIP RD between the girder supports S-GRDR below and proximate the intermediate baffle or girder H-GRDR.

The first group fluid distribution devices 930*a* includes at least four fluid distribution devices and, in some embodiments, includes no more than eight and, in some embodiments, no more than six fluid distribution devices 920 for the protection of the upper HIP region UHIP. In various such embodiments, the four of the first group fluid distribution devices 930*a* are spaced apart and axially aligned perpendicular to the central ridge line RD and preferably centered between the first end HE1 of the HIP Section and the intermediate baffle or girder H-GRDR. In the embodiments of FIGS. 16A-16C, the first fluid distribution devices 930*a* can include two fluid distribution devices centrally aligned in the upper HIP region UHIP parallel with central ridge formation RD perpendicular to the other four fluid distribution devices.

The second group fluid distribution devices 930*b* can include eight to ten and, in some embodiments, six to eight fluid distribution devices 930 located below the intermediate baffle or girder H-GRDR in the protection of the lower HIP region LHIP. At least four fluid distribution devices of the second group fluid distribution devices 930*b* are spaced apart and axially aligned perpendicular to the central ridge line RD below the second end HE2 and the intermediate baffle or girder H-GRDR and preferably centered between the girder supports S-GRDR. In some embodiments, the four fluid distribution devices are located three to six feet from the intermediate baffle or girder H-GRDR. To protect the corner creeper regions CRPRs, the second group includes at least one fluid distribution device within or adjacent in close proximity to the creeper regions, in some embodiments. In the embodiments shown in FIGS. 15A-15B, two fluid distribution devices are located internally or medially of the girder supports S-GRDR and disposed about HIP ridge line HIP-RD.

In each of the embodiments of the system shown in FIGS. 16B and 16C, a fluid distribution device can be located within the corner creeper region CRPR between the intermediate baffle or girder H-GRDR and the HIP ridge truss TR-HIP RD. In the embodiments of the system 900 such as shown in FIG. 16C, the second group of fluid distribution devices 930*b* are fluid supplied by the independent fluid control thermal detection devices 920*a*, 920*b*. In some embodiments, such as shown in FIG. 16A, the system 900 can include one or more automatic fluid distribution devices in the corner creeper regions CRPR. In some embodiments, the deluge sub-system systems in the protection of the HIP region have a maximum of twelve open fluid distribution devices. In some embodiments, the system 900 can include more than twelve open fluid distribution devices, preferably no more than eighteen, to sufficiently wet and protect the HIP region including its corner creeper regions CRPR and realize a desirable fluid density, such as ranges from 0.05 GPM/SQ. FT. to less than 0.1 GPM/SQ. FT., for example fluid density ranging from 0.073 GPM/SQ. FT. to 0.080 GPM/SQ. FT., and in some embodiments the fluid density 0.05 GPM/SQ. FT.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

What is claimed is:

1. A deluge fire protection system for the protection of an attic space section defined by a ceiling base defining a span of no more than eighty feet and a roof deck sloped above the ceiling to form a ridge line centered above the ceiling base and a peak region of the attic space proximate the ridge line with two eave regions disposed about the ridge line, the attic space having a first end and a second end spaced apart from the first end along the ridge line to define a length of the attic section, the system comprising:

at least one draft curtain between the first and second end disposed perpendicular to the ridge line to define at least two baffled regions of the attic space, a plurality of fluid control thermal detection devices aligned along the ridge line proximate the peak region;

and a plurality of open fluid distribution devices each coupled to one of the plurality of fluid control thermal detection devices to define no more than six sectional deluge sub-systems spaced apart in an alternating arrangement from the first end to the second end, each deluge sub-system including the one fluid control thermal detection device of the plurality of fluid control thermal detection devices no more than two feet from the ridge line, the one fluid control thermal detection device comprising a thermally responsive element and a valve coupled with the thermally responsive element, the valve to control a fluid flow with the plurality of open fluid distribution devices; and no more than three fluid distribution devices of the plurality of open fluid distribution devices pipe connected with the one fluid control thermal detection device with the no more than three fluid distribution devices being axially aligned and spaced apart from one another between the ridge line and one of the eave regions in a direction perpendicular to the ridge line, the axial alignment of the fluid distribution devices of adjacent deluge sub-systems being oppositely directed about the ridge line toward the one of the eave regions to define the alternating arrangement, the plurality of fluid distribution devices laterally spaced from the one fluid control thermal detection device by between four feet and twelve feet and from an intersection of the ceiling base and the roof deck by between seven feet and twelve feet such that no fluid distribution device of the plurality of fluid distribution devices is closer than seven feet from the intersection, the plurality of fluid distribution devices to output fluid having a density greater than or equal to 0.05 gallons per minute (GPM) per square foot (SQFT) and less than 0.1 GPM/SQFT.

2. The system of claim 1, wherein each of the at least two baffled regions has a baffled region length to define the number of the fluid control thermal detection devices protecting the baffled region, wherein the baffled region length ranges from one of (i) 0-4 ft. such that the number of the fluid control thermal detection devices is one; (ii) 4-12 ft. such that the number of the fluid control thermal detection devices is two; and (iii) 12-24 ft. such that the number of the fluid control thermal detection devices is three.

3. The system of claim 2, wherein the at least two baffled region includes a baffled region with one of the fluid control thermal detection devices spaced four feet from the draft curtain.

4. The system of claim 2, wherein the at least two baffled region includes a baffled region with at least two of the fluid control thermal detection devices spaced eight feet from one another.

5. The system of claim 1, wherein the span ranges from twenty to forty feet, each of the deluge sub-systems having only one of the fluid distribution devices laterally off-set from the fluid control thermal detection device at a distance ranging from four to ten feet (4-10 ft.).

6. The system of claim 5, wherein the span is twenty feet, each of the deluge sub-systems having only one of the fluid distribution devices laterally off-set from the fluid control thermal detection device, the distance ranging from four to six feet (4-6 ft.).

7. The system of claim 1, wherein the span ranges from forty to eighty feet (40-80 ft.), each of the deluge sub-systems having at least two of the fluid distribution devices laterally off-set from the fluid control thermal detection device with a first of the at least two fluid distribution devices ranging at a distance from seven to twelve feet (7-12 ft.) from the fluid control thermal detection device and at least a second fluid distribution device of the at least two fluid distribution devices at a distance from seven to twelve feet (7-12 ft.) from an eave region of the two eave regions.

8. The system of claim 7, further including a third fluid distribution device of the plurality of fluid distribution devices between the first and second fluid distribution device.

9. The system of claim 1, wherein the plurality of fluid control thermal detection devices includes no more than six of the fluid control thermal detection devices aligned along the ridge formation proximate the peak region and the plurality of open fluid distribution devices consists of no more than eighteen of the open fluid distribution devices.

* * * * *